US012540291B2

(12) United States Patent
Hsu

(10) Patent No.: US 12,540,291 B2
(45) Date of Patent: Feb. 3, 2026

(54) MICROENCAPSULATION OF FRICTION MODIFIER ADDITIVES AND OTHER ADDITIVES FOR PERFORMANCE ENHANCEMENT IN AUTOMOTIVE AND INDUSTRIAL APPLICATIONS

(71) Applicant: The George Washington University, Washington, DC (US)

(72) Inventor: Stephen Hsu, Germantown, MD (US)

(73) Assignee: The George Washington University, Washington, DC (US)

( * ) Notice: Subject to any disclaimer, the term of this patent is extended or adjusted under 35 U.S.C. 154(b) by 0 days.

(21) Appl. No.: 17/807,584

(22) Filed: Jun. 17, 2022

(65) Prior Publication Data

US 2023/0088019 A1 Mar. 23, 2023

Related U.S. Application Data

(60) Provisional application No. 63/322,412, filed on Mar. 22, 2022, provisional application No. 63/247,369, filed on Sep. 23, 2021.

(51) Int. Cl.

| | |
|---|---|
| ***C10M 177/00*** | (2006.01) |
| ***C10M 169/04*** | (2006.01) |
| *C10N 20/00* | (2006.01) |
| *C10N 20/06* | (2006.01) |
| *C10N 30/00* | (2006.01) |
| *C10N 30/10* | (2006.01) |
| *C10N 40/25* | (2006.01) |
| *C10N 50/00* | (2006.01) |
| *C10N 70/00* | (2006.01) |

(52) U.S. Cl.

CPC ..... *C10M 177/00* (2013.01); *C10M 169/04* (2013.01); *C10N 2020/019* (2020.05); *C10N 2020/06* (2013.01); *C10N 2020/061* (2020.05); *C10N 2030/10* (2013.01); *C10N 2030/54* (2020.05); *C10N 2040/25* (2013.01); *C10N 2050/12* (2020.05); *C10N 2070/00* (2013.01)

(58) Field of Classification Search

CPC .... B01J 13/18; C10M 169/04; C10M 101/02; C10M 149/20; C10M 149/22; C10M 2203/022; C10M 2215/02; C10M 2223/045; C10M 2217/046; C10M 2217/045; C10N 2020/01; C10N 2030/06; C10N 2050/01; C10N 2050/12

See application file for complete search history.

(56) References Cited

U.S. PATENT DOCUMENTS

| | | | |
|---|---|---|---|
| 3,418,656 | A | 12/1968 | Vassiliades |
| 5,112,541 | A | 5/1992 | Friend |
| 5,292,835 | A | 3/1994 | Jahns et al. |

(Continued)

FOREIGN PATENT DOCUMENTS

| | | | |
|---|---|---|---|
| CN | 101348600 | A | 1/2009 |
| DE | 102009031342 | A1 | 1/2011 |

(Continued)

*Primary Examiner* — Vishal V Vasisth

(74) *Attorney, Agent, or Firm* — BLANK ROME LLP

(57) ABSTRACT

The present disclosure relates to microencapsulated friction modifiers additives used in lubricants or other solutions, to their preparation, and to the use thereof to improve fuel economy of the engines and machines by enhancing friction reduction and prolonging the friction reduction time period.

12 Claims, 23 Drawing Sheets

(56) References Cited

U.S. PATENT DOCUMENTS

| | | | |
|---|---|---|---|
| 5,610,529 | A | 3/1997 | Schwindt |
| 6,403,057 | B1 | 6/2002 | Schneider et al. |
| 7,976,812 | B2 | 7/2011 | Yamada et al. |
| 8,734,840 | B2 | 5/2014 | Marteaux et al. |
| 8,808,720 | B2 | 8/2014 | Mulqueen et al. |
| 10,265,672 | B2 | 4/2019 | Gauckler et al. |
| 10,611,983 | B2 | 4/2020 | Hsu et al. |
| 2005/0129946 | A1 | 6/2005 | Hayashi |
| 2005/0277549 | A1 | 12/2005 | Seitz et al. |
| 2013/0146009 | A1 | 6/2013 | Pederson et al. |
| 2013/0210969 | A1* | 8/2013 | Grigoriev ..... C10M 171/06 524/92 |
| 2014/0087982 | A1 | 3/2014 | Calcavecchio et al. |
| 2015/0225640 | A1 | 8/2015 | Crews et al. |
| 2017/0073610 | A1* | 3/2017 | Hsu ..... C11D 17/0039 |
| 2017/0224849 | A1 | 8/2017 | Carroll et al. |
| 2019/0185782 | A1 | 6/2019 | Webster et al. |

FOREIGN PATENT DOCUMENTS

| | | | |
|---|---|---|---|
| EP | 1965638 | A2 | 9/2008 |
| JP | 2004/188325 | A | 7/2004 |
| JP | 4210477 | B2 | 1/2009 |
| WO | WO-2013/053450 | A1 | 4/2013 |

* cited by examiner

A FM microcapsule made by interfacial polymerization has shell thickness of 0.45μm 3 smaller PM capsules encapsulated inside a large capsule Fig. Continuous release + triggered release via thermal or high shear Multicore capsules with mixed FMs as small capsules inside Microcapsules after additive release Porous microcapsules fabrication as a function of non-wetting agent concentrations from 0-3% from A-E Porous microcapsules sent for engine testing for fuel economy testing Capsules containing nanoparticles adsorbed on surface for charge modification Fuel economy Chassis engine dynamometer test results in a V8 350hp engine with variable timing and active fuel management

| | FTP city | FFE HY | COMBINED | % Improvement |
|---|---|---|---|---|
| Baseline oil A | 18.445 | 28.973 | 22.050 | |
| Microcapsules added oil B | 18.305 | 29.318 | 22.028 | FTP -0.81<br>FFE +1.21 |
| 500 mileage accumulation | | | | |
| 2nd test, oil B | 18.578 | 29.118 | 22.192 | FTP +0.69<br>FFE +0.65 |

Fig. 22

MICROENCAPSULATION OF FRICTION MODIFIER ADDITIVES AND OTHER ADDITIVES FOR PERFORMANCE ENHANCEMENT IN AUTOMOTIVE AND INDUSTRIAL APPLICATIONS

CROSS REFERENCE TO RELATED APPLICATIONS

This application claims the benefit of U.S. Provisional Application Nos. 63/247,369, filed Sep. 23, 2021, and 63/322,412, filed Mar. 22, 2022, the entire contents of each of which are hereby incorporated by reference.

STATEMENT REGARDING FEDERALLY SPONSORED RESEARCH OR DEVELOPMENT

This invention was made with government support under EE0006870 awarded by DOE EERE. The U.S. government has certain rights in the invention.

FIELD OF THE INVENTION

The present invention relates to microencapsulated friction modifiers additives used in lubricants or other solutions, to their preparation, and to the use thereof to improve fuel economy of the engines and machines by enhancing friction reduction and prolonging the friction reduction time period.

BACKGROUND OF THE INVENTION

Fully formulated engine oil, including friction modifiers, lubricates moving components of an engine. For example, oil lubricates pistons that reciprocate in cylinders, a crankshaft that rotates on bearings, and a camshaft that drives intake and exhaust valves. Oil can reduce friction between moving components and coat metal components to inhibit corrosion. Thus, oil can control friction, wear, and heating in the engine.

Chemical additives are usually included in oil to increase its performance. For example, oil may include antioxidant additives that prevent the oil from thickening and slow down its oxidative degradation, friction modifier additives that reduce friction to increase fuel economy, and dispersant and detergent additives that keep the engine clean.

Engine lubricants are changed at regular intervals (i.e., at a specified mileage or a time to change interval). The change intervals are set by engine manufacturers to safeguard engine durability. Used oil from oil changes contributes to environmental contamination if not properly treated. Accordingly, there is a need for longer oil change intervals (long drain oils), while maintaining the engine health.

Automotive and diesel engines have a unique operating environment, including temperatures up to the maximum ring zone temperatures (about 200° C. for cars and up to 350° C. for heavy duty tractor trailer trucks). These high temperatures create a hostile environment for many lubricant additives, including dispersants, detergents, viscosity improver (VI) polymers, and friction modifiers, leading to their rapid depletion and loss of effectiveness as the oil ages in the engine.

Surface active, friction modifying additives (friction modifiers) were introduced after the 1973 oil crisis to boost fuel economy. Over the years, various friction modifiers have been developed, and many of them have well-documented antagonistic interactions with anti-wear additives and dispersants. For example, polar acid- and ester-based friction modifiers often compete for surface adsorption sites with anti-wear additives. Furthermore, these polar acid- and ester-based friction modifiers form mixed micelles with dispersants, thereby reducing their effective concentration (or dosage) in the oil. Excessive amounts of polar molecules, e.g., oxidation products of lubricating oil (aldehydes, carboxylic acids, ketones, etc.), can negatively impact the effectiveness of antiwear additive and friction modifiers, resulting in a faster depletion rate, as well as changing the pH of the lubricant, which can change the repulsive forces between the polymeric capsules and the additives.

To survive hostile conditions in engines and to minimize or overcome negative additive-additive interactions, there is a need to protect the friction modifiers from interactions and degradation and to maximize friction modifier effectiveness. Microcapsulated friction modifiers have been proposed as a way to meet this need.

Conventional microcapsules will not survive the harsh conditions in an operating internal combustion engine. Some of the environmental conditions existing in an engine and resulting requirements include the following:

i) Temperature ranges from −30° C. to 250° C.

ii) Shear stresses from the oil injector pump to circulate the oil throughout the engine.

iii) High mechanical shear stresses between cam lifter contact, up to 3 GPa at 110° C.

iv) Average mean contact pressures at the engine bearings approaches 200 to 700 psia v) Lubricant contains a large number of polar chemical additives used to control rust, corrosion, wear, friction; the oil also contains detergents and dispersants to clean the engine surfaces. Most of the additives used in lubricants are negatively charged, and some polymeric capsules are also negatively charged, so the repulsive force separates the capsules from the other additives in the oil solution. Capsules that do not carry such charge repulsion will agglomerate with other additives to form aggregates, and therefore will not function in automotive or diesel engines.

vi) The chemical additives that are encapsulated have to be released and immediately begin to function in this complex, multifunctional soup and exert their individual influence.

vii) In addition to the extreme conditions mentioned above, other extreme environmental conditions also exist, including: ambient temperature, capsules idling in the oil sump floor with inputs of moisture, blowby gases, and fuel dilution from the combustion chamber, oxidation occurring and the oxidation products (hydroxyls, aldehydes, acids, etc.) pushing pH of the oil towards more acidic. In addition, the polymeric microcapsules will aggregate and coalesce with one another, unless prevented by specific repulsive forces resulting from surface designs.

viii) Since the microcapsules are dispersed in the oil, the oil will pass through the oil filter. There are two types of oil filters used in automotive vehicles: pore controlled filters and depth filtration filters. The nominal pore size is about 40 μm diameter, but for various filter systems used in the vehicle fleet, the effective pore size tends to be around 28 μm. Therefore, the microcapsule size will be limited to below the effective pore size diameters.

ix) To provide timed-release of additives, capsules have to survive in this complex, always changing chemical mixture, and undergo high shear stresses inside the sliding interfaces, high contact pressures, and high temperatures. The natural triggering mechanisms to release additive from the capsule would be shear rupture of the capsule or high temperature induced breaking up of the capsules.

x) Automotive engines are designed to operate up to 200,000 miles, so the engine has to be kept relatively clean. The lubricant contains dispersants and detergents to clean the engine and transport the oil-insolubles to the oil sump to be disposed during oil changes. Microcapsules used in engines, the polymer chemistry used to form the capsules has to be compatible with the oil chemistry, preferably to be able to be dissolved into the hot oil at or near the ring zone temperatures (>~ 100° C.).

xi) The lubricant in the oil sump is being pumped throughout the engine, the volume percent of oil being circulated at any one instant, however, is relatively small. While the oil circulation is rapid for the pumped oil, the un-pumped oil with the capsules could sit on the bottom of the oil pan for some period of time under relatively moderate conditions.

xii) Depending on the specific engine used to test the lubricant containing microcapsules, different oil filters are being used. Some engine test stand use metal screens with defined pore size, some vehicle engines use commercial filtration systems to keep engine clean.

xiii) Convention microcapsules made by common recipes will not survive or function under some or all of these conditions. In the automotive engine operation, all of conditions i)-xii) exist but some components will be exposed to some conditions more than others. For the capsules to function properly, they will need to meet some or all of conditions i)-xii) listed above. This is why microcapsulated lubricant additives have not been used in automotive lubrication application thus far.

To be effective for prolonging the life time of FM contained microcapsules, the microcapsules will need to survive the engine operating conditions involving the ring/liner, bearings, and cam-lifter contact environment, the wall thickness, capsule size distribution, porosity of microcapsules, and chemical stability of the capsules have to be designed and controlled to survive in an operating engine for a long time and release the additive when needed into the lubricant without detrimental effect on the engine such as increased varnish and sludge.

Attributes necessary to work in the automotive engine oils include:

i) The size of the microcapsules should be smaller than 20 μm diameter depending on the filter pore size. If the filter is a depth fiber filter, the size has to be below μm diameter.

ii) The number of capsules per unit volume should be kept small below the haze limit (too many capsules per unit volume would induce haze appearance for the lubricant).

iii) The additive release capacity (total amount of additives released eventually) should be at least 50%, preferably at 70% or higher.

iv) The shell wall thickness should be mechanically strong enough to withstand the shear induced by the oil pump.

v) The shell wall should be smooth with or without controlled through holes for continuous release of additives to control the release rates.

vi) The capsules are designed to break or release additives through diffusion through the capsule shell through holes fabricated by design, or release the additive(s) based on a built-in triggering mechanism such as thermal or shear, vii) The spent capsules should be soluble in oil at piston ring zone temperatures, or the shell material should not negatively impact the lubricant performance.

viii) The individual capsule additive recovery % rate should be higher than 50% or above, preferably around 70%. Based on item 2 in this paragraph, low recovery rate will increase the number of capsules and decrease the yield of additive per capsule. In practical terms, one needs a minimum of capsules to deliver maximum additive content to provide necessary performance dosage.

There are many microencapsulation processes developed since it was first patented in 1955. See, U.S. Pat. No. 2,800,457. Since then, many microencapsulation processes have been developed to create new products in a wide variety of applications, such as scratch-and-sniff, drug delivery, time release pesticides, cosmetics, and others. These processes are generally referred to as "recipes" defining the chemicals and the amount of the starting materials to be used and the temperatures for the microencapsulation process. These recipes often omit some details such as stirring power input, oil and water interfacial fluid thickness control, polymerization temperatures (exothermic reaction), cooling method (air bubble, baffles, etc.), emulsifiers purity, and the use of combination emulsifiers, etc. Therefore, such recipes do not provide full information sufficient to reproduce the microencapsulation process.

In reality, the physical and chemical properties of the microcapsules produced define the process. Therefore, processing steps, equipment used, and the resulting microcapsule properties effectively conventional methods of microencapsulation have certain difficulties in that the microencapsulation produces microcapsules of irregular shape and inconsistent wall thickness, clumping of the microcapsules into a large cluster, and low yields of microcapsules (recovery rate at 40%, unable to release high dosage of additive into the oil upon capsule breakup). Moreover, they are mostly used in pharmaceutical applications for drug delivery, cosmetics, electrophotography, or food wherein the mechanical strength of the microcapsules is low. The polymer used for shell formation is of edible origin (e.g., cellulose-based), which forms a membrane type polymeric shell which has poor shear stability. Due to low mechanical strength, poor temperature and shear stability, these types of polymeric/non-polymeric microcapsules cannot be used in engine applications.

There is therefore a need for new microencapsulation processes that produce microcapsules that can be effective under the harsh lubricant working conditions described above.

SUMMARY OF THE INVENTION

The present invention provides a new generation of mechanically robust microcapsules with and without through holes for i) continuous additive release of one or more friction modifiers (up to four or five combinations of friction modifiers, antioxidants, and both organic and inorganic friction modifiers) in engine oil and industrial lubricants; and ii) triggered release of additives under thermal, shear, and temperature set points or combination of these triggers.

Several processing methods are described herein to create these unique microcapsules, including, for example, interfacial polymerization, solvent evaporation, and layer by layer deposition. After the initial microcapsules are formed, capsule property modifications were made to create controlled porosity to allow diffusion-release of additives, and the capsule surface charge is modified to enable the capsules to pass through various oil filters to deliver the additives to the engine. The present invention provides methods to alter the properties of the capsules to enable them to be used in various engine models, oil filter designs, and duty cycles, and power range, and engine tolerance ranges.

Engine designs are evolving rapidly to suit a large range of duty cycles and fuel economy targets mandated by legislatures in different regions. New advanced materials are introduced into engines to improve engine efficiency and durability. Lubricants containing the appropriate amount of microcapsules according to the present invention will prolonged low friction properties and improve fuel economy against the baseline lubricant without microcapsules; and can maintain low friction over a time surpassing the normal un-capsulated oils as demonstrated by engine chassis dynamometer tests under controlled conditions by overcoming the challenges described above and meeting the requirements described above.

U.S. Pat. No. 10,611,983 describes the microencapsulation of chemical additives, the entire contents of which are hereby incorporated by reference herein.

In one aspect, the present invention relates to a method for microencapsulating lubricant additives. In one embodiment, the method comprises:

(a) preparing an aqueous suspension of an emulsifier;

(b) preparing a solution comprising (i) at least one lubricant additive; (ii) a polymer; and (iii) an organic solvent;

(c) emulsifying the solution of step (b) by mixing in the aqueous suspension of step (a) and stirring;

(d) heating the emulsified solution of step (c);

(e) cooling the emulsified solution;

(f) forming microcapsules by diluting (e.g., with an organic solvent) the emulsified solution of step (e); and (g) isolating the microcapsules resulting from step (f).

In one embodiment of any of the methods described herein, the method further comprises the step of (h) washing the microcapsules.

In one embodiment of any of the methods described herein, the method further comprises the step of: (i) drying the microcapsules.

In one embodiment of any of the methods described herein, the method further comprises the step of: (j) sieving the microcapsules for uniformity of the microcapsule size range.

In one embodiment of any of the methods described herein, the at least one lubricant additive is selected from the group consisting of friction modifiers, antioxidant additives, antiwear additives, corrosion inhibitors, and mixtures thereof.

In one embodiment of any of the methods described herein, the at least one lubricant additive is selected from the group consisting of friction modifiers, antioxidant additives, and mixtures thereof.

Additional Chemical Additives

The microcapsules prepared as described herein include one or more chemical additives.

In one embodiment, the one or more chemical additives are selected from the group consisting of lubricant additives (such as, but not limited to, antioxidants, detergents, dispersants, antiwear additives, surface deactivators, acid neutralizing agents, lubricant film enhancers, smart viscosity modifiers, corrosion inhibitors, rust inhibitors, high base materials, reparative agents, power point depressants, seal compatibility agents, antifoam agents, and viscosity index improvers), heat transfer agents (such as, but not limited to, phase change materials, local heat sinks and heat sources), surface reactivity control agents (such as, but not limited to, metal nanoparticles); and any active agents that may be used to improve the performance of existing lubrication systems or to enable performance levels that cannot be reached by the existing technology, and any combination thereof Antioxidants Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, e.g., Klamann, Lubricants and Related Products: Synthesis, Properties, Applications, International Standards, March 1984, and U.S. Pat. Nos. 4,798,684 and 5,084,197.

Useful antioxidants may include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type include, but are not limited to, 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic to antioxidants may include, for example, hindered 2,6-di-alkyl-phenolic proprionic ester derivatives. Bis-phenolic antioxidants may also be advantageously used. Examples of ortho-coupled phenols include, for example, 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include, for example, 4,4'-bis(phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include, for example, alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as napthyl. Aromatic groups $R_8$ and $R_9$ may be joined together with other groups such as S.

Typical aromatic amines antioxidants have alkyl substituent groups of at least 6 carbon atoms. Examples of aliphatic groups include, for example, hexyl, heptyl, octyl, nonyl, and decyl. Generally, the aliphatic groups will not contain more than 14 carbon atoms. The general types of amine antioxidants useful in the present microcapsules include, for example, diphenylamines, phenyl naphthylamines, phenothiazines, imidodibenzyls and diphenyl phenylene diamines. Mixtures of two or more aromatic amines may also be used. Polymeric amine antioxidants can also be used. Particular examples of aromatic amine antioxidants include, for example, p,p'-dioctyldiphenylamine; t-octylphenyl-α-naphthylamine; phenyl-α-naphthylamine; and p-octylphenyl-α-naphthylamine.

Sulfurized alkyl phenols and alkali or alkaline earth metal salts thereof also are useful antioxidants.

Additional suitable antioxidants include hindered phenols and arylamines. These antioxidants may be used individually by type or in combination with one another.

Detergents

A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of 1.05:1 to 50:1 on an equivalent basis. More preferably, the ratio is from 4:1 to 25:1. The resulting detergent is an overbased detergent that will typically have a total base number (TBN) of 150 or higher, often 250 to 450 or more. Preferably, the overbasing cation is sodium, calcium, or magnesium. A mixture of detergents of differing TBN can be used.

Suitable detergents include, for example, the alkali or alkaline earth metal salts of sulfonates, phenates, carboxylates, phosphates, and salicylates, e.g., a mixture of magnesium sulfonate and calcium salicylate.

Sulfonates may be prepared from sulfonic acids that are typically obtained by sulfonation of alkyl substituted aromatic hydrocarbons. Hydrocarbon examples include, for example, those obtained by alkylating benzene, toluene, xylene, naphthalene, biphenyl and their halogenated derivatives (chlorobenzene, chlorotoluene, and chloronaphthalene, for example). The alkylating agents typically have 3 to 70 carbon atoms. The alkaryl sulfonates typically contain 9 to 80 carbon or more carbon atoms, more typically from 16 to 60 carbon atoms.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include, for example, isobutylphenol, 2-ethylhexylphenol, nonylphenol, and dodecyl phenol. Starting alkylphenols may contain more than one alkyl substituent that are each independently straight chain or branched. When a non-sulfurized alkylphenol is used, the sulfurized product may be obtained by methods well known in the art. These methods include, for example, heating a mixture of alkylphenol and sulfurizing agent (including elemental sulfur, sulfur halides such as sulfur dichloride) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include, for example, long chain alkyl salicylates. One useful family of compositions is of the formula

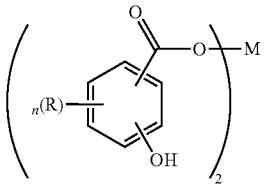

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium.

More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Suitable detergents include, for example, calcium phenates, calcium sulfonates, calcium salicylates, magnesium phenates, magnesium sulfonates, magnesium salicylates and other related components (including borated detergents) in any combination. In one embodiment, the detergent includes magnesium sulfonate and calcium salicylate.

Anti-Wear Additives

A metal alkylthiophosphate, for example, a metal dialkyl dithio phosphate in which the metal constituent is zinc, or zinc dialkyl dithio phosphate (ZDDP) is a suitable anti-wear additive. ZDDP can be primary, secondary or mixtures thereof. ZDDP compounds generally are of the formula $Zn[SP(S)(OR^1)(OR^2)]2$ where $R^1$ and $R^2$ are $C_1$-$C_{18}$ alkyl groups, preferably $C_2$-$C_{12}$ alkyl groups. These alkyl groups may be straight chain or branched.

Preferable zinc dithiophosphates which are commercially available include secondary zinc dithiophosphates such as those available from, for example, The Lubrizol Corporation under the trade designations "LZ 677A", "LZ 1095" and "LZ 1371", from, for example, Chevron Oronite under the trade designation "OLOA 262" and from, for example, Afton Chemical under the trade designation "HITEC 7169".

Pour Point Depressants (PPDs)

Conventional pour point depressants (also known as lube oil flow improvers) may be used to lower the minimum temperature at which a lubricating fluid will flow or can be poured. Examples of suitable pour point depressants include, for example, polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. See, e.g., U.S. Pat. Nos. 1,815,022, 2,015,748, 2,191,498, 2,387,501, 2,655, 479, 2,666,746; 2,721,877, 2,721,878 and 3,250,715.

Dispersants

During engine operation, oil-insoluble oxidation byproducts are produced. Dispersants help keep these byproducts in solution, thus diminishing their deposition on metal surfaces. Dispersants used in a lubricating oil may be ashless or ash-forming in nature. In one embodiment, the dispersant is ashless. So-called ashless dispersants are organic materials that form substantially no ash upon combustion. For example, non-metal-containing or borated metal-free dispersants are considered ashless. In contrast, metal-containing detergents form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. One useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. See, e.g., U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471071.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canadian Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. See U.S. Pat. No. 4,426,305.

The molecular weight of the hydrocarbyl substituted succinic anhydrides used in the preceding paragraphs will typically range between 800 and 2,500. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amities. See U.S. Pat. No. 4,767,551. Process aids and catalysts, such as oleic acid and sulfonic acids, can also be part of the reaction mixture. Molecular weights of the alkylphenols range from 800 to 2,500. See, e.g., U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HN^{TM}{}_2$ group-containing reactants.

Hydrocarbyl substituted amine ashless dispersant additives are well known to one skilled in the art. See, for example, U.S. Pat. Nos. 3,275,554; 3,438,757; 3,565,804; 3,755,433, 3,822,209, and 5,084,197.

Suitable dispersants include, for example, borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a molecular weight (Mn) of from 500 to 5000 or a mixture of such hydrocarbylene groups. Additional dispersants include succinic acid-esters and amides, alkylphenol-polyamine-coupled Mannich adducts, their capped derivatives, and other related components. One dispersant is polyisobutylene succinimide polyamine (PIBSA-PAM).

Seal Compatibility Agents

Seal compatibility agents help to swell elastomeric seals by causing a chemical reaction in the fluid or physical change in the elastomer. Suitable seal compatibility agents include, for example, organic phosphates, aromatic esters, aromatic hydrocarbons, esters (butylbenzyl phthalate, for example), and polybutenyl succinic anhydride.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional amounts along with other additives such as demulsifiers.

Viscosity Index Improvers

Viscosity index improvers (also known as VI improvers, viscosity modifiers, and viscosity improvers) can be included in lubricant compositions. Viscosity index improvers provide lubricants with high and low temperature operability. These additives impart shear stability at elevated temperatures and acceptable viscosity at low temperatures. Suitable viscosity index improvers include, for example, high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers include, for example, linear or star-shaped polymers and copolymers of methacrylate, butadiene, olefins, or alkylated styrenes. Polyisobutylene is a commonly used viscosity index improver. Another suitable viscosity index improver is polymethacrylates (copolymers of various chain length alkyl methacrylates, for example), some formulations of which also serve as pour point depressants. Other suitable viscosity index improvers include, for example, copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE©" (such as "PARATONE© 8921" and "PARATONE© 8941"); from Afton Chemical Corporation under the trade designation "HiTEC©" (such as "HiTEC© 5850B"; and from The Lubrizol Corporation under the trade designation "Lubrizol 7067C". Polyisoprene polymers are commercially available from Infineum International Limited, e.g., under the trade designation "SV200"; diene-styrene copolymers are commercially available from Infineum International Limited, e.g. under the trade designation "SV 260".

Suitable corrosion inhibitors, rust inhibitors, high base materials, reparative agents, heat transfer agents, surface reactivity control agents, surface deactivators, acid neutralizing agents, lubricant film enhancers, and smart viscosity modifiers for use in the present invention are known to those skilled in the art. See, e.g., Klamann, Lubricants and Related Products: Synthesis, Properties, Applications, International Standards, March 1984.

In one embodiment, the amount of chemical additive present in the microcapsules prepared as described herein is from about 0.1 to about 10 wt. %, such as from about 0.1 to about 5 wt. %, from about 0.5 to about 2.5 wt. %, from about 0.75 to about 2.5 wt. %, from about 1 to about 2.5 wt. % or from about 1 to about 2 wt. %. In one embodiment, the amount of chemical additive present in the microcapsules is about 1 wt. % when the microcapsules are added to a lubricant. In one embodiment, the amount of additive present in the microcapsules is about 2 wt. % when the microcapsules are added to a lubricant Lubricants In another aspect the present invention relates to a lubricant comprising a microcapsule prepared according to any of the embodiments described herein.

Lubricant Oil Base Stocks

A wide range of lubricating base oils is known in the art. Lubricating base oils that are useful include both natural oils, and synthetic oils, and unconventional oils (or mixtures thereof can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes poly alpha-olefins (PAO). Group V base stock includes base stocks not included in Groups I-IV. The table below summarizes properties of each of these five groups.

Base Oil Properties

| | Saturates | Sulfur | Viscosity Index |
|---|---|---|---|
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes poly alpha-olefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, British Petroleum, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. See, e.g., U.S. Pat. Nos. 4,149,178 and 3,382,291. Other descriptions of PAO synthesis may be found in U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 14 cSt to 20 cSt often being more to preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include t-butyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Additional useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce tube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or to hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably FT material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived may be an F-T material (i.e., hydrocarbons, waxy hydrocarbons, wax).

In addition, the GTL base stock(s) and/or base oil(s) are typically highly paraffinic (>90% saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils include any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluents/carrier oil for additives used on an "as-received" basis. Even in regard to the Group II stocks, it is preferred that the Group II stock be in the higher quality range associated with that stock, i.e., a Group II stock having a viscosity index in the range 100<VI<120.

The base oil typically constitutes the major component of an engine oil lubricant composition and is typically present in an amount ranging from 50 to 99 weight percent, preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or mm.sup.2/s) at 100.degree. C. Mixtures of synthetic and natural base oils may be used if desired.

The types and quantities of lubricant additives are not limited by the examples shown herein as illustrations.

When lubricating oil compositions contain microcapsules comprising one or more of the chemical additives prepared as discussed above, the additive(s) are blended into the composition in an amount sufficient for it to perform its intended function. In one embodiment of any of the methods described herein, the emulsifier is selected from the group consisting of ionic emulsifiers, non-ionic emulsifiers, and mixtures thereof.

In one embodiment of any of the methods described herein, the polymer in step (b) is pre-formed.

In one embodiment of any of the methods described herein, the polymer in step (b) is formed in-situ.

In one embodiment of any of the methods described herein, the concentration of the emulsifier is in the range of between about 0.05 and about 2.0 wt. %, such as, for example, between about 0.1 and about 0.5 wt. %.

In one embodiment of any of the methods described herein, the stirring speed in step (c) is in a range of between about 500 and about 20,000 rpm.

In one embodiment of any of the methods described herein, the organic solvent is selected from the group consisting of alcohols, ethers, ketones, esters, hydrocarbons, halogenated hydrocarbons, aromatic hydrocarbons and any combination thereof.

In one embodiment of any of the methods described herein, the emulsified solution in step (d) is heated to a temperature of between about 20° C. to about 100° C.

In one embodiment of any of the methods described herein, the emulsified solution is cooled to room temperature in step (e).

In one embodiment of any of the methods described herein, the solution of step (b) comprises two or more lubricant additives.

In one embodiment of any of the methods described herein, the emulsifier is an ionic emulsifier selected from the group consisting of sodium dodecylsulfonate, sodium dodecyl benzene sulfonate, dioctyl sulfosuccinate sodium, hexadecyltrimethylammonium bromide, poly(ethylene-alt-maleic anhydride), and any combination thereof.

In one embodiment of any of the methods described herein, the emulsifier is a non-ionic emulsifier is selected from the group consisting of gum arabic, polyvinyl alcohol, poly styrene-co-maleic anhydride, polyethylene glycol, polypropylene glycol, polyoxyethylene octyl phenyl ether, TWEEN 20, TWEEN 40, TWEEN 60, TWEEN 80, Span 20, Span 60, Span 65, and any combination thereof.

In one embodiment of any of the methods described herein, the polymer in step (b) is selected from the group consisting of at least one polymethacrylate, poly methyl methacrylate, polystyrene, poly urea formaldehyde, poly melamine formaldehyde, cellulose, polylactide, poly(lactide-co-glycoside), and any combination of any of the foregoing.

In another aspect, the present invention relates to a microcapsule comprising:

(a) at least one lubricant additive selected from the group consisting of friction modifiers, antioxidant additives, and any mixture thereof; and (b) at least one polymer shell encapsulating the at least one lubricant additive, wherein:

(i) a surface of the microcapsule is smooth, (ii) a size of the microcapsule is between about 1 μm and about 40 μm, such as e.g., between about 5 μm and about 20 μm, and (iii) a thickness of the polymer shell is between about 0.1 μm and about 2 μm, such as e.g., between about 0.5 μm and about 1.5 μm.

In one embodiment of any of the microcapsules described herein, the microcapsule is shear resistant.

In one embodiment of any of the microcapsules described herein, the microcapsule releases the encapsulated additive upon changing temperature, pH, or stress, or a combination thereof.

In one embodiment of any of the microcapsules described herein, the temperature is changed to ring zone conditions.

In one embodiment of any of the microcapsules described herein, the temperature is changed to a range between about 250° C. and about 400° C., such as between about 180° C. and about 250° C.

BRIEF DESCRIPTION OF THE DRAWINGS

FIGS. 14A-14E show the porosity as a function of the non-wetting agents used in creating porous holes in the shell, FIG. 14A is zero non-wetting agent used. FIG. 14E is 3% non-wetting agent used. FIGS. 14B-14D are various concentrations in between.

FIG. 22 is a table showing engine chassis dynamometer test results using microcapsulated FMs running in a 5 sets of daily driving cycles using the EPA fuel economy sequences.

DETAILED DESCRIPTION OF THE INVENTION

As used herein the following definitions shall apply unless otherwise indicated.

As used herein, the term "room temperature" refers to a temperature in the range from about 15 to about 30° C., preferably from about 20 to about 25° C.

As used herein, the term "shear resistant" refers to the ability of a microcapsule to withstand a shear force (such as that experienced in an engine) without rupture.

As used herein, the term "ring zone conditions" or "ring zone temperature" refers to the conditions or temperature due to the piston ring rubbing the cylinder liner under engine operating conditions.

As used herein, the term "through hole" refers to a clear hole through a capsule wall that connect the inside of the capsule to the surrounding environment As used herein, the term "microcapsules" means hollow microcapsules comprising a solid or liquid core and a shell or membrane (typically polymeric) enclosing the solid or liquid core. The microcapsules contain one or more lubricant chemical additives, or combinations of additives, to be protected and to be released in controlled manner One embodiment of the present invention is a method for microencapsulating friction modifiers additives (FMs) to achieve friction reduction beyond normal life time of friction modifiers blended into the lubricant.

In addition, present invention also provides novel microencapsulation methods to include FMs, friction reduction enhancers and inhibitors to prevent the degradation of the friction reducing lubricating films in a single capsules.

In another embodiment, the methods described herein may be used to encapsulate a combination of additives, including, for example, the FMs, antioxidants, antiwear additives together with enhancers and protectors in a single capsule, including but not limited in terms of other additional additives, to be encapsulated as a mini package of additives in a formulation. The present invention applies, e.g., both to lubricants used in vehicle engines lubricants used in industrial machineries.

Figure 13A:
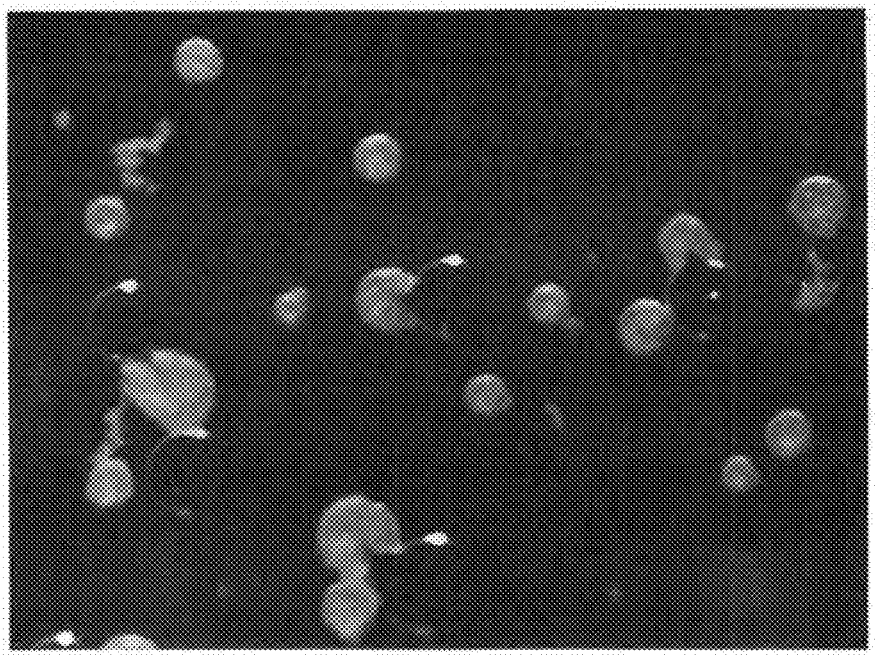
FIG. 13A shows an optical microscope image illustrating the microcapsule releasing additives.
Figure 13B:
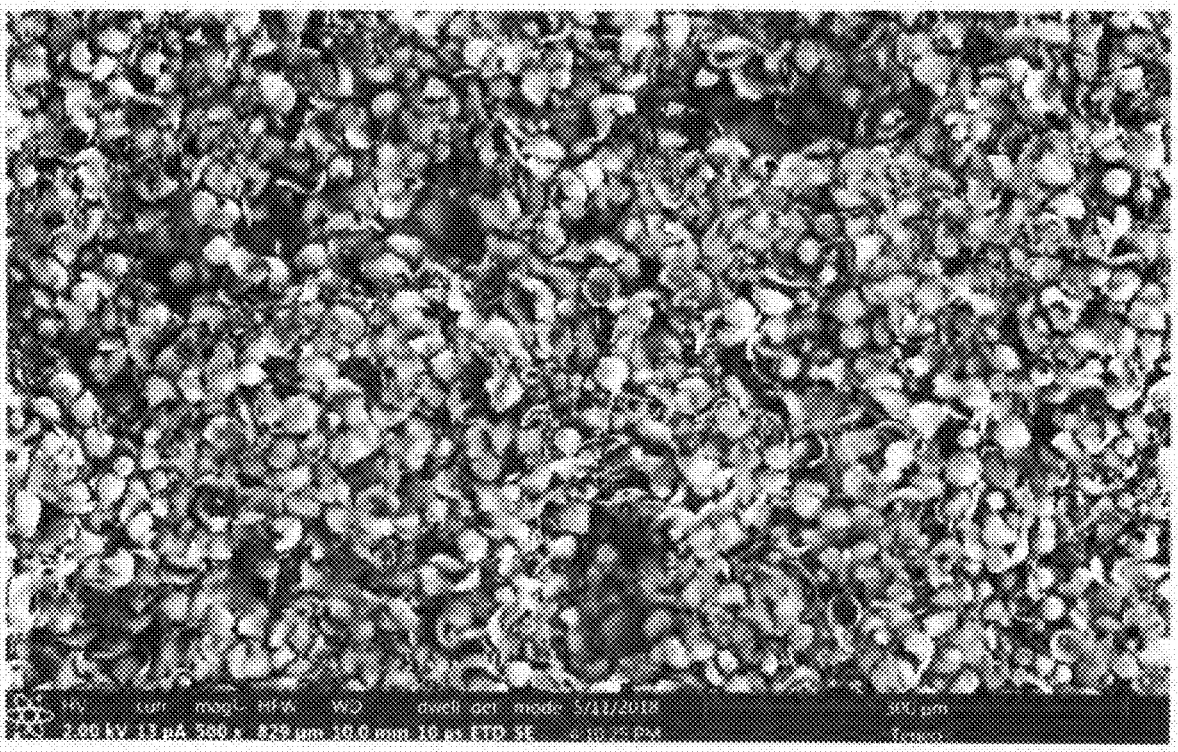
FIG. 13B shows a scanning electron microscopy image of the dried broken capsules after the additive release.
Figure 14:
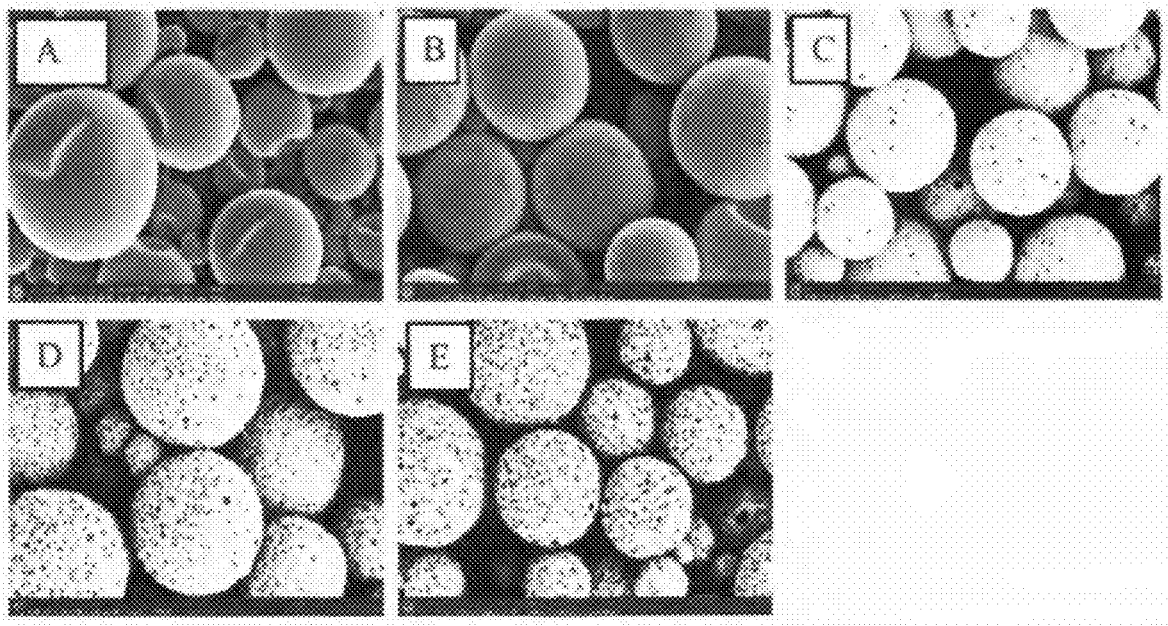
FIG. 14 shows a scanning electron microscopy (SEM) image illustrating the effect of adding non-wetting agents to create varying degree of porosity for continuous release, in accordance with the present invention.
Figure 15:
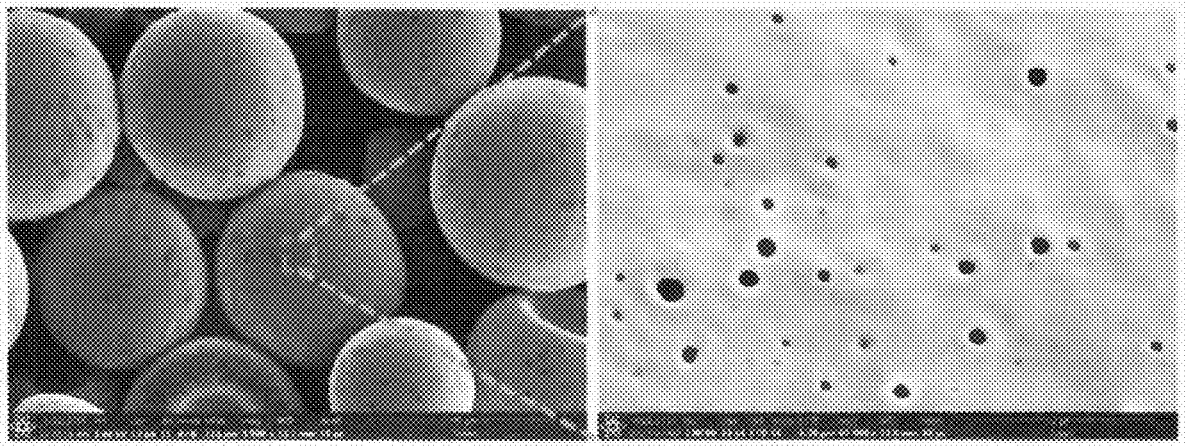
FIG. 15 shows a scanning electron microscopy (SEM) image illustrating the porous microcapsules with strong mechanical strengths in accordance with the present invention. These capsules were submitted for engine tests. The left-hand picture is the original picture taken of the microcapsule. The right-hand picture is the magnified picture of the square area to show the porous holes in the shell.
Figure 16:
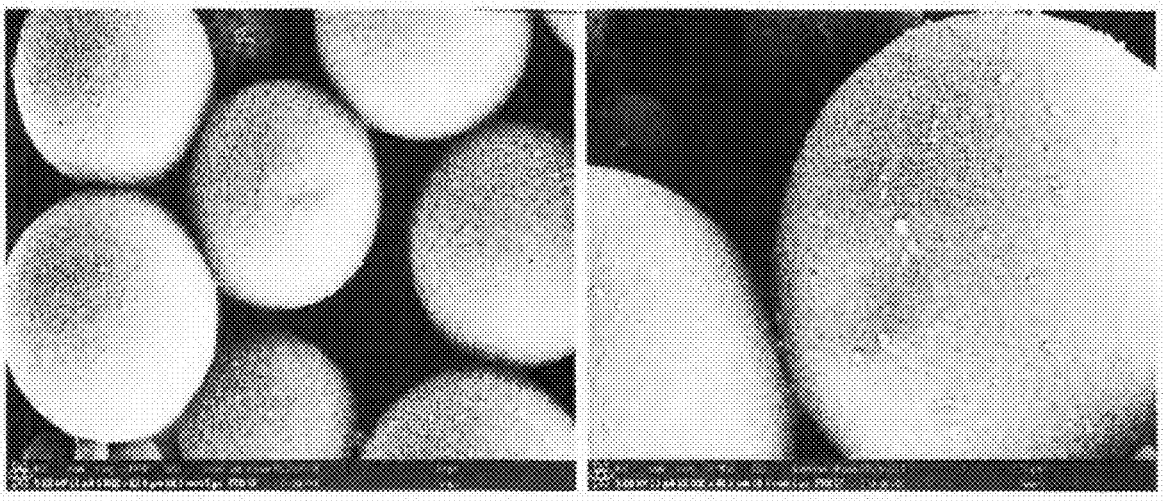
FIG. 16 shows a scanning electron microscopy (SEM) image of microcapsules illustrating another embodiment of the present invention to modify and control the surface charges of the microcapsules to either negative charge, positive charge or neutral charge to avoid entanglement or aggregation with other additives, or another medium such as charged filter elements. The left-hand picture shows the original magnification. The right-hand picture shows a larger magnification to show the details of the nano silica particles attached to the shell wall.

The microcapsules described herein may be added as a minor component to the non-polar lubricating base stock oil. The microcapsules described herein include a core material containing a solvent and polar/non-polar or combinations of the lubricant additive, more precisely friction modifiers, having solubility in the polar solvent and a polymeric shell or a membrane enclosing the core. The solubility of the polar lubricant additive in the non-polar lubricating oil base stock is enhanced by microencapsulating the additive in the core-shell form. The microencapsulated additive is released into the lubricant based on triggers such as i) a set temperature above which the capsule wall would collapse; ii) a set shear level above which the capsule would open; and iii) a set normal pressure when the capsule is in a sliding interface above the pressure capsule would open. FIGS. 13A and 13B illustrate additive release of microcapsule prepared according to the present invention. The microencapsulation of lubricant additives provides a means to enhance the life of the additives in the engine by protecting them against the harsh conditions that exist in the engine.

Friction modifying ("FM") additives are chemicals that (i) reduce the coefficient of friction (i.e., the ratio of the tangential force divided by the normal force), thereby achieving lower friction and smoother sliding under applicable loads, or (ii) increase the coefficient of friction, slower the sliding speed up to stopping the sliding. Usually, FM additives form adsorbed surface films on both sliding surfaces, thus achieving friction modification under sliding interfaces.

FM additives that reduce the coefficient of friction conserve energy and are mostly applied in engine oils and automotive engine drive-train gear oils. These additives can provide 2-15% friction reduction in various laboratory bench tests, leading to the potential of improvements in engine fuel economy.

FM additives which reduce the coefficient of friction are usually polar molecules soluble in lubricating base oils. They are molecules/compounds containing oxygen, sulfur, nitrogen, molybdenum, copper, carbon, etc. These coefficient-of-friction-reducing FM additives adsorb on the surface or antiwear films and tend to increase oil film strength by physical and chemical adsorption on both surfaces, thereby creating film to film sliding contacts, reducing friction. The film thickness is influenced by the length of the alkyl chains of the additive molecules. Thus, as FM additives, long chain compounds, such as, but not limited to, fatty acids, fatty alcohols, fatty esters, fatty amines/amides and glycerides, are used. Some FM additives also contain sulfur containing compounds, e.g., sulfurized olefins, sulfurized fats, oil soluble molybdenum sulfur compounds, molybdenum disulfide and graphite.

Organic FM additives adsorb on the antiwear film formed on the metal surface of engines and remain in place to separate mating surfaces. They are effective when the normal loading is not too excessive, i.e., where penetration of the oil film by surface asperities is not significant. Under boundary lubrication conditions (i.e., conditions wherein the load is supported by the contacting surfaces and wear is possible), the coefficient of friction is reduced by a tribochemically formed lubricating layer which has layer structure to reduce friction similar to the use of solid lubricants such as $MoS_2$ or graphites. Oil soluble molybdenum-containing FMs are also commonly used.

Figure 7:
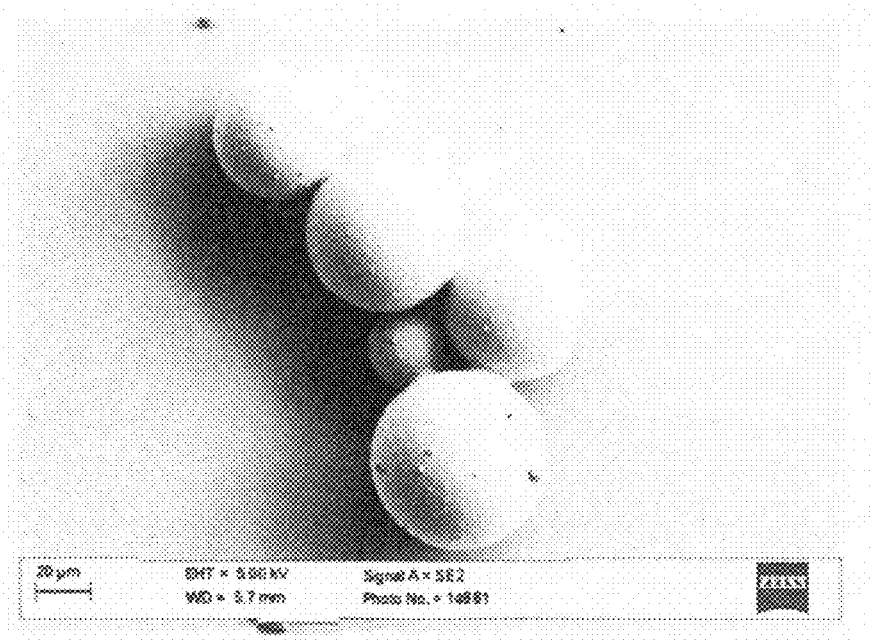
FIG. 7 shows a scanning electron microscopy (SEM) image of the surface morphology of microcapsules prepared in accordance with the methods described herein with a polar friction modifier (FM) as the core.
Figure 8:
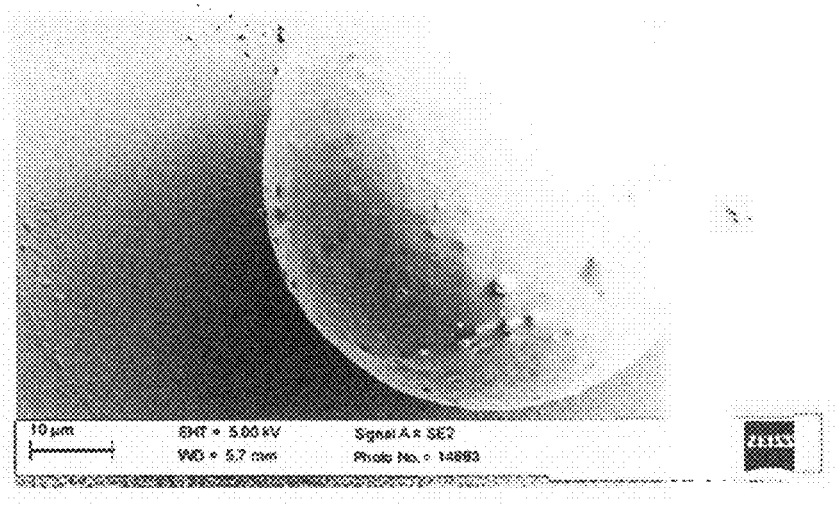
FIG. 8 shows a scanning electron microscopy (SEM) image of microcapsules prepared in accordance with the methods described herein with a mixture of friction modifiers and supplemental additives in the microcapsule core.
Figure 10:
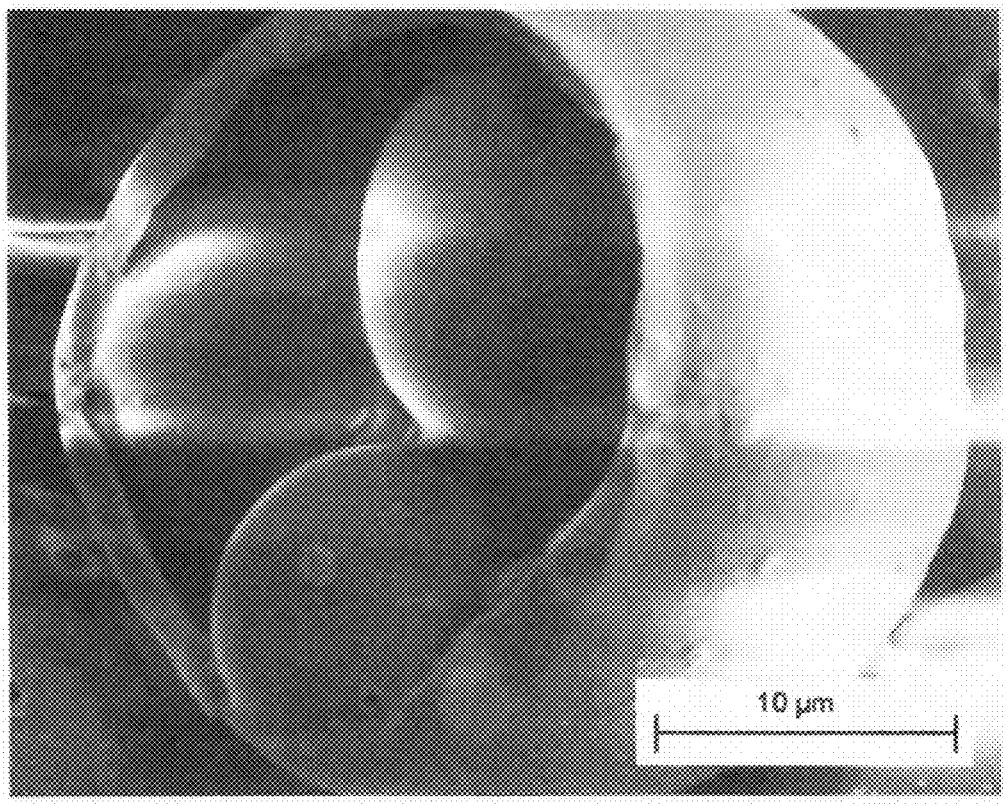
FIG. 10 shows a scanning electron microscopy (SEM) image of a novel mother ship microcapsule according to one of the aspect of the present invention, containing three separate smaller capsules, each houses either the same FM or different FMs, enabling a single capsule of the normal microcapsule size to deliver the combined effect of up to three separate additives when the capsule was triggered to release the additives.
Figure 11:
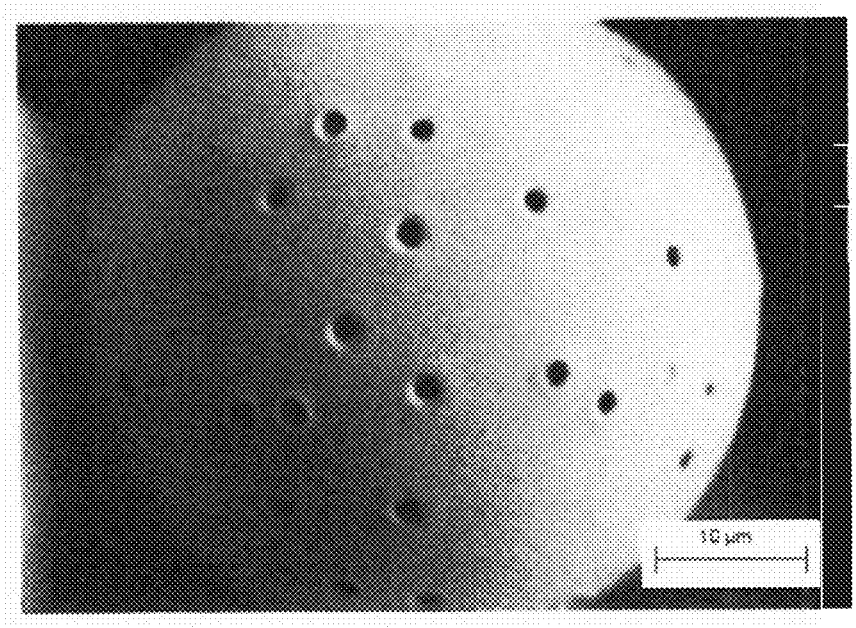
FIG. 11 shows a scanning electron microscopy (SEM) image of a microcapsule with clear through holes of controlled hole size to allow continuous release of the additive or the core content in a unique aspect of the present invention.
Figure 12:
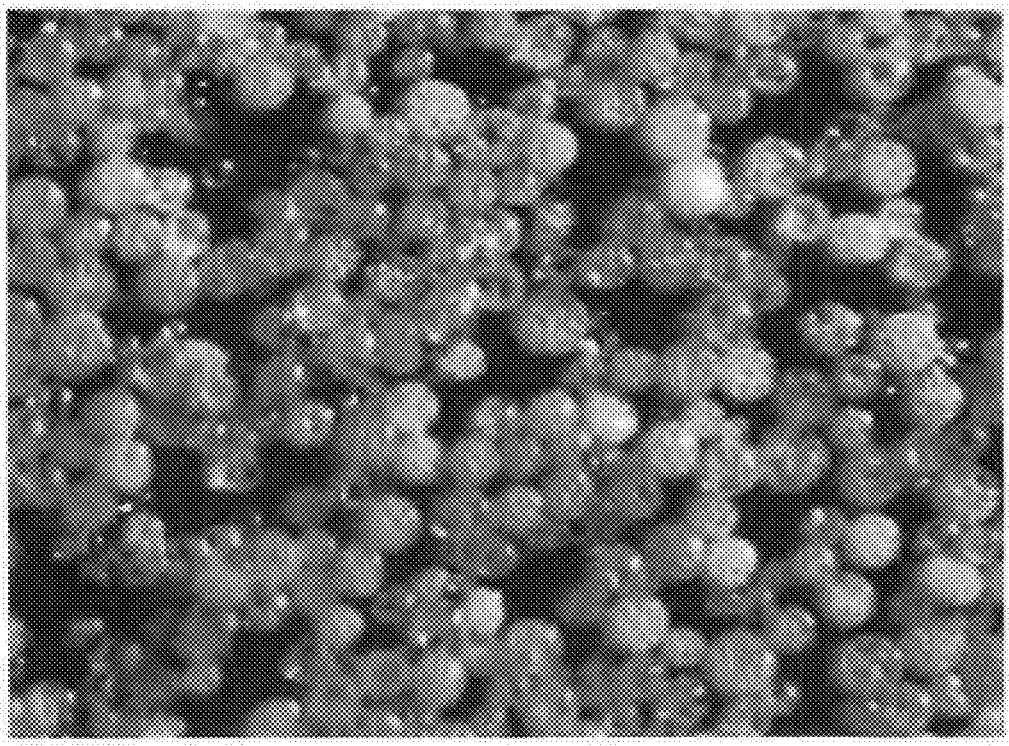
FIG. 12 shows an optical microscope image illustrating another embodiment of a microcapsule of the present invention where the shell wall is a transparent membrane thin wall with many smaller thin-wall capsules containing FMs.

One aspect of the present invention is a microcapsule comprising at least one friction modifier additive and at least one polymer shell. FIG. 7 provides a SEM image of microcapsules with a polar additive. FIGS. 8 and 10 illustrate multicore microcapsules. The multicore capsules can be fabricated to contain separate different additive(s) as well as the same additives. The fabrication of different additives in the core mini-capsules is a new process described herein where different capsules are fabricated beforehand with the capsule surface charge modified so that the intended capsules tend to be attracted to the other two. When interfacial polymerization emulsion is carried out, they tend to group together in the emulsion. Then they form compound capsules. This aspect of the present invention is especially useful when used in synergistic additive combinations as well as in self-repair applications.

Figure 6:
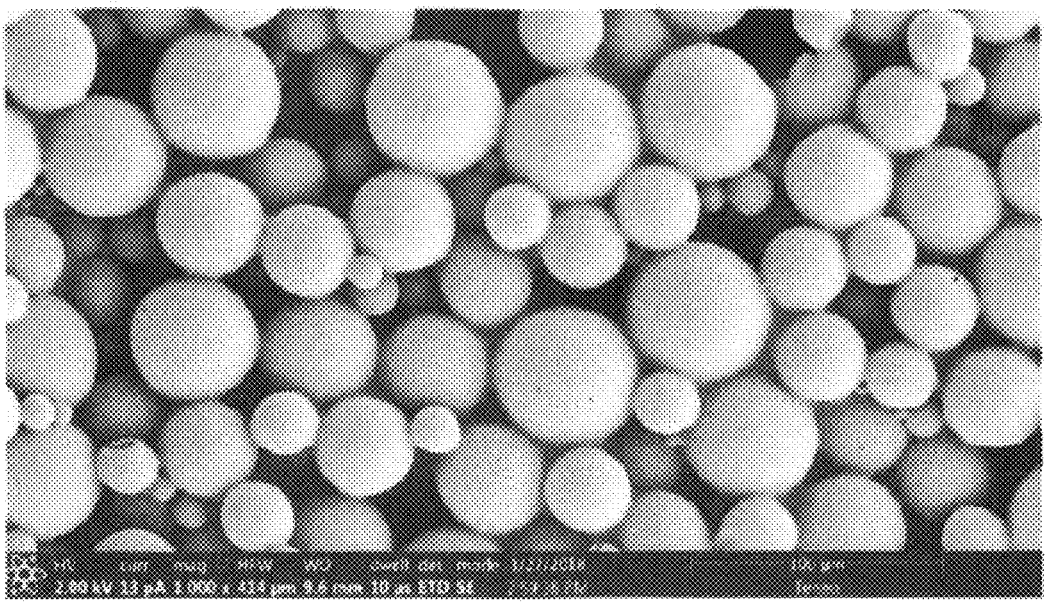
FIG. 6 shows a scanning electron microscopy (SEM) image of microcapsules containing friction modifiers prepared in accordance with the methods described herein, showing the initial size distribution of the microcapsules.

In one embodiment of any of the microcapsules described herein, the surface of the microcapsule is smooth. FIGS. 6, 7 and 8 provide illustrations of the surface morphology of a microcapsule prepared as described herein, with a polar additive core or a mixed additives core according to the present invention.

Figure 5:
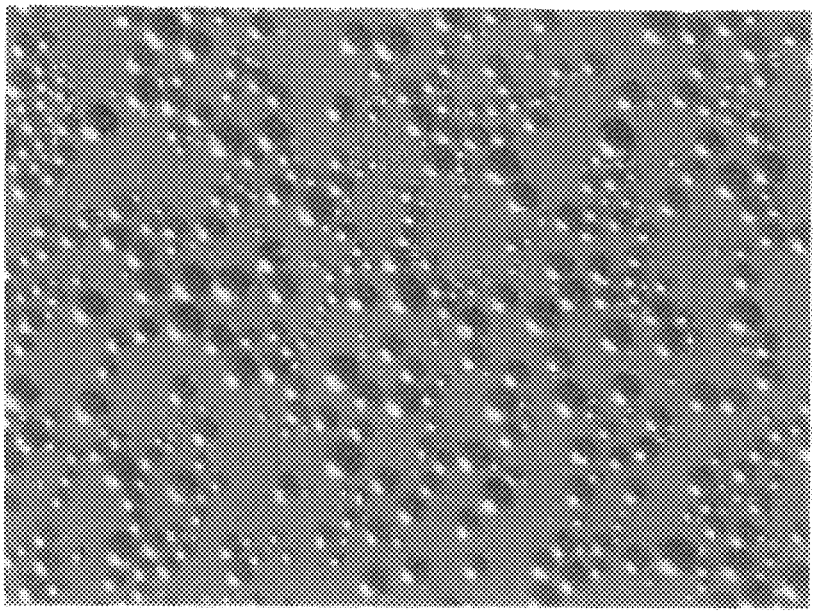
FIG. 5 shows an optical microscope image of microcapsules prepared in accordance with the methods described herein with friction modifiers, showing the initial microcapsule size distribution.

In another embodiment, for transportation applications, the size of any of the microcapsules described herein is tailored to from about 1 μm to about 30 μm diameter. The size will change somewhat depending on engine designs, filtration systems, and duty cycles. FIG. 5 shows the initial microcapsule size distribution, which is bi-modal with one dominant larger size and a smaller uniform size. These sizes are primarily determined by the stirrer size and shape and the power input in the interfacial polymerization process. The microcapsules after washing, and drying, can go through a sieving process to separate the sizes. The selected size range is to ensure that the microcapsules can pass through the pores of filters in various engines. The size distribution of microcapsules can be controlled through processing conditions and the degree of mixing or evaporation temperature or sieving.

Figure 9:
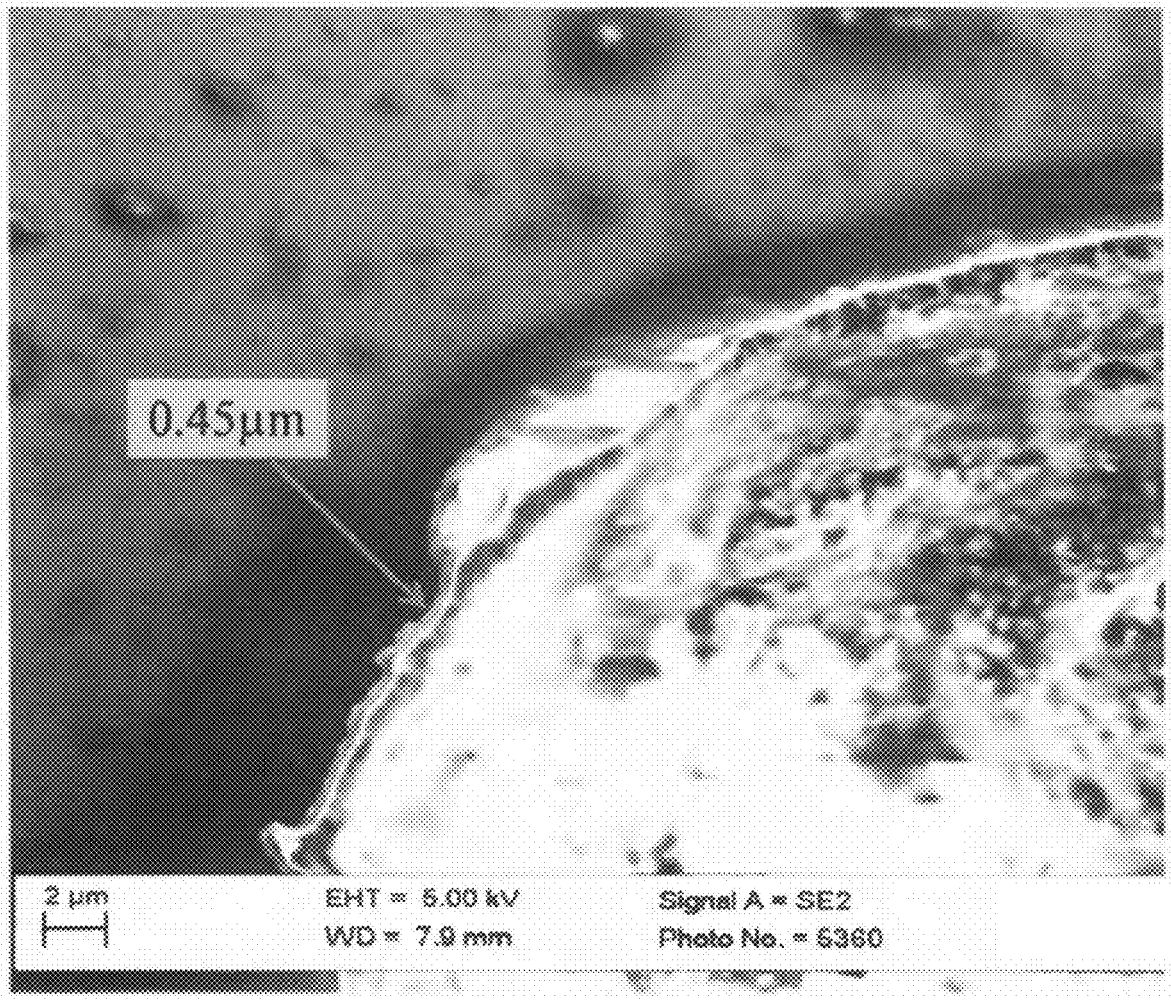
FIG. 9 shows a scanning electron microscopy (SEM) image of the cut microcapsule exposing the shell wall, with a thickness of about 0.45 μm.

In another embodiment of any of the microcapsules described herein, the thickness of the microcapsule shell wall is between about 0.3 μm and about 1.5 μm. FIG. 9 provides an illustration of the shell thickness of a microcapsule prepared according to the methods described herein. A preferred shell thickness is 0.3 μm to 0.6 μm to achieve optimum strength and stability.

The thickness and the effectiveness of the adsorbed film of FM additives that reduce the coefficient of friction is a function of the following variables:

i) Polar group: the stronger the polarity, the greater the adsorption strength and higher tenacity of the adsorbed film.

ii) Alkyl Chain length: the longer the chain, the thicker the adsorbed film.

iii) Configuration: straight chain and branched chains allow closer packing and higher cohesion when cross-linked.

iv) Base oil: solubility of additive depends on aromatic and polar content of the molecules.

v) Concentration: the higher the concentration, the higher is the FM additive effect, up to a point; then it could become uneconomical or tend to produce results opposite those desired.

vi) Surface composition: metals have free electrons providing active adsorption sites, ceramics and insulators only have dangling bonds, much smaller active sites, therefore much less adsorption sites and bonding strength when these materials are used for the same FM.

Figure 1:
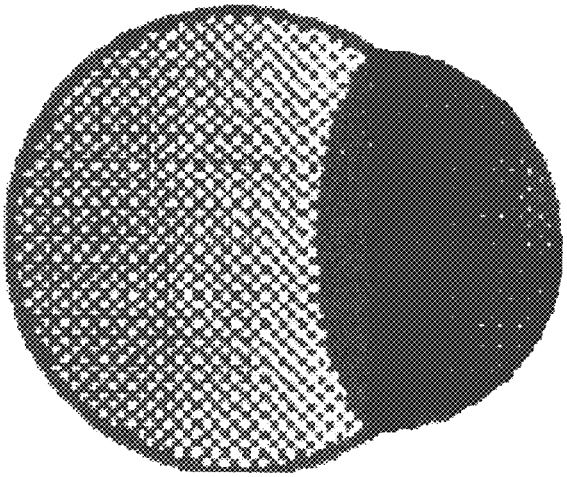
FIG. 1 is an illustration of an acorn-like particle that results from the encapsulation of an organic polar friction modifier (FM) using conventional methods.
Figure 2:
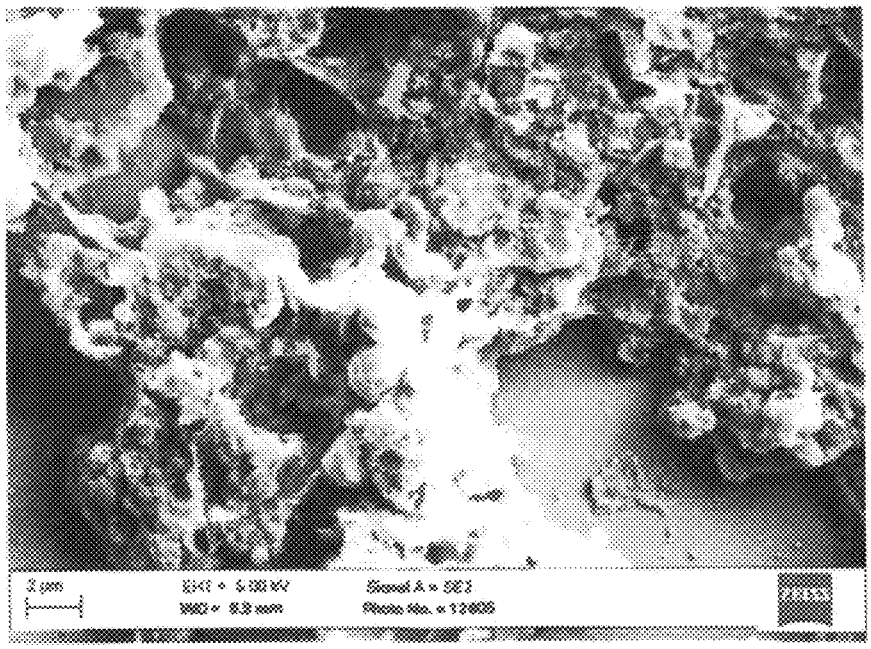
FIG. 2 is an illustration of a failed encapsulation process of an organic polar FM using a conventional interfacial polymerization recipe.
Figure 3:
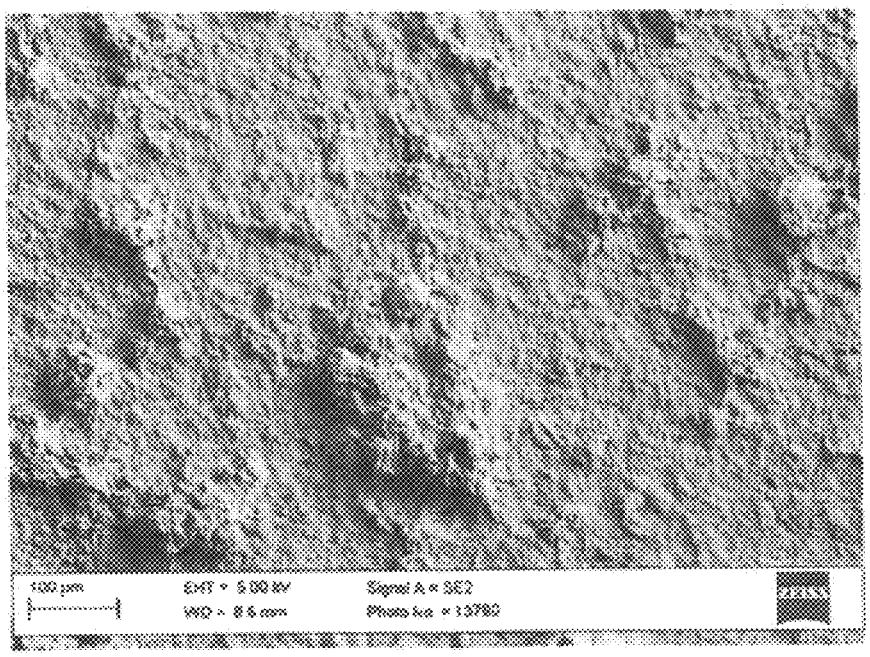
FIG. 3 is an illustration of a failed encapsulation process of a polar FM additive using a conventional radical polymerization recipe.
Figure 4:
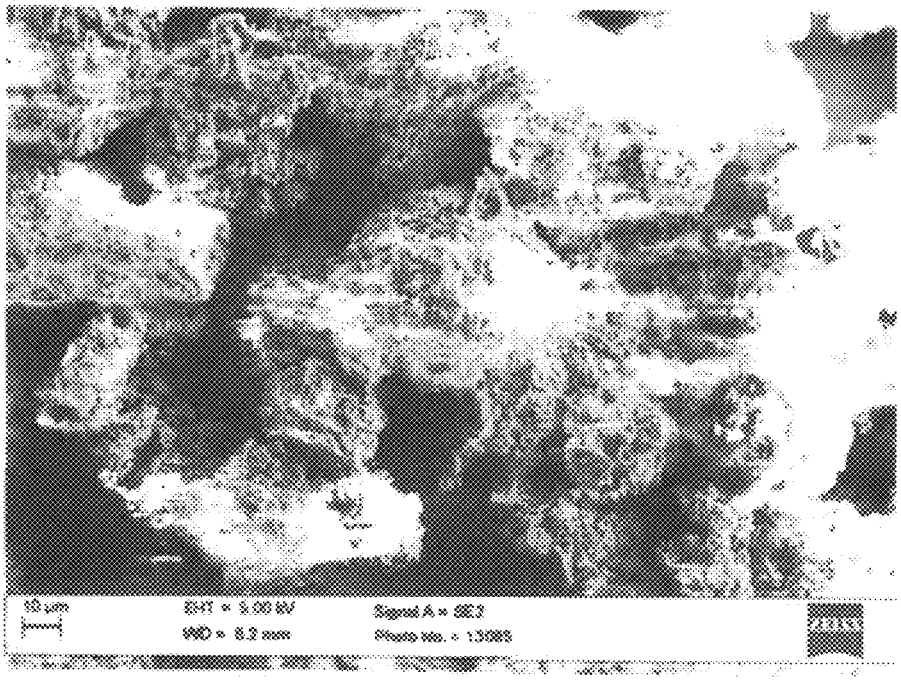
FIG. 4 is an illustration of a failed encapsulation process of a polar friction modifier additive by emulsion polymerization using conventional methods.

Linear short-chain organic acids have been encapsulated using emulsion/interfacial, radical polymerization with a polymeric shell wall formed from PMMA (poly methyl methacrylate), polystyrene, PUF (poly urea formaldehyde), PMF (poly melamine formaldehyde) (see, e.g., Mahdavian, et al., *Macromolecules,* 2011, 44, 7405-7414 and Loxley et al., *J. Colloid and Interface Science,* 1998, 208, 49-62). These methods use in-situ polymerization of methyl-methacrylate monomer to form the PMMA polymer. These conventional methods work to encapsulate non-polar molecules, but the encapsulation of polar molecules (e.g., octanol) gave 'acorn' type particles, as shown in FIG. 1. In this case, the key determining factor was the low interfacial tension between octanol and the aqueous phase. Surfactants that reduce the oil-water interfacial tension too much were unsuitable as emulsifiers for forming core/shell microcapsules by these methods, yielding "acorn" shape particles. Failed encapsulation of polar lubricant additives using conventional methods is illustrated in FIGS. 2-4.

One example of the microencapsulation process described herein is illustrated for the encapsulation of polar and non-polar molecules (tricresylphosphate, crodamide O, paraffin wax, etc.) were performed. Paraffin wax formed microcapsules, but polar organic friction modifiers such as crodamide O, amine O, mono-, di-, triglycerides, and antiwear additive such as tricresylphosphate all failed to form successful microcapsules with defined capsule shapes.

Unsuccessful microencapsulation of the polar additives suggests that the conventional microencapsulation methods/recipes were not able to overcome the polar long chain limitation to allow direct microencapsulation of such molecules, including some organic friction modifiers.

For most of the encapsulation processes, emulsifiers are used to create stable emulsions. Emulsifiers are mostly long chain polar molecules with a hydrophilic end group at one end of the molecule and an oleophilic end group on the other end. When a encapsulate target molecule is also a polar long chain molecule (e.g., glycerol mono-oleate) as the core material, the emulsifier may entangle/mix with the encapsulate forming stable emulsions or mixtures, thus the process will fail to produce the desired microcapsules containing the desired core molecules.

In contrast to conventional methods, one superior aspect of the present invention is the ability to encapsulate polar long chain organic molecules, which make up one key part of the friction modifier family. Long chain polar molecules intrinsically carry a net electrostatic surface charge (dipole moment). In a solution of polar molecules, like charges repulse one another, and opposite charges attract. In creating stable emulsions, there must be a balance of surface charges. If the charge of a compound/molecule can be changed by coupling with another molecule (surrogate molecules, not necessarily carrying FM characteristics), either opposite charged molecule or neutral molecule, the overall combination of the two molecular clusters will exhibit an overall net charge which is different from the individual starting compound/molecule, and in sometimes, a near neutral charge may result. So, if the polar long chain molecule can be coupled with a surrogate molecule/compound, the resulting aggregate will be easily emulsified to form stable emulsion, hence, to be capsulated. The charge intensity of the combined molecules/compound can be manipulated by varying the ratio of the two molecules. In this way, two or more lubricant additives can be combined to change the polarity/charge on the resultant molecular compound to enable successful microencapsulation. This use of multiple additive molecules or the use of a non-functioning surrogate molecule to control the charge is novel and new, solving one of the long standing barriers of polar additive encapsulation.

For successful microencapsulation of chemicals/additives, each microencapsulation process should include the following four processing steps:

i) Microencapsulation of the selected lubricant additive;

ii) Quantitative recovery of the additive from the microcapsules;

iii) Functionality tests be immediately performed on the recovered additive to ensure that the intended function had not changed; and iv) The microencapsulated additive(s) should be blended into a formulation to be tested to make sure that the microencapsulated additive(s) can perform key application-specific performance tests showing intended advantage.

One embodiment of the present invention is a method for microencapsulating friction modifiers additives, comprising the steps of:

(a) preparing an aqueous suspension of an emulsifier, (b) preparing a solution comprising one or more friction modifier additives, (c) optionally adding (depending on application specific requirements) (i) one or more antioxidants, surface deactivators, or a combination thereof, (iii) a polymer; (iv) an organic solvent, or any combination of any of any of the foregoing to the solution of step (b);

(d) emulsifying the solution of step (b) or step (c) (if performed) by mixing in the aqueous suspension of step (a);

(e) heating the emulsified solution of step (d);

(f) cooling the heated emulsified solution of step (d);

(g) diluting the cooled emulsified solution with one or more solvents (e.g., one or more organic solvents) to form microcapsules; and (h) optionally isolating, washing, and drying the resulting microcapsules.

Emulsifiers used in any of the methods described herein include ionic emulsifiers and non-ionic emulsifiers, and any combination thereof.

Suitable ionic emulsifiers that may be used in any of the methods described herein include, but are not limited to, sodium dodecylsulfonate, sodium dodecyl benzene sulfonate, dioctyl sulfosuccinate sodium, hexadecyltrimethylammonium bromide, poly(ethylene-alt-maleic anhydride), cetrimonium bromide, and any combination thereof.

Suitable non-ionic emulsifiers that may be used in any of the methods described herein may include, but are not limited to, gum arabic, polyvinyl alcohol, poly styrene-co-maleic anhydride, polyethylene glycol, polypropylene glycol, polyoxyethylene octylphenylether, polymethacrylic acid, TWEEN 20, TWEEN 40, TWEEN 60, TWEEN 80, Span 20, Span 60, Span 65, and any combination thereof.

Suitable polymers that may be used in any of the methods described herein include, but are not limited to, polymethacrylate, polystyrene, poly urea formaldehyde, poly melamine formaldehyde, cellulose, polylactide, poly(lactide-co-glycoside), and any combination thereof.

Suitable organic solvents that may be used in any of the methods described herein include, but are not limited to, alcohols, ethers, ketones, esters, hydrocarbons, halogenated hydrocarbons, aromatic hydrocarbons, and any combination thereof.

Low molecular weight hydrocarbon base oils may also be used as the solvent(s)

Examples of alcohols that may be used in any of the methods described herein include, but are not limited to, methanol, ethanol, n-propanol, isopropanol, n-butanol, sec-butanol, and tert-butanol.

Examples of ethers that may be used in any of the methods described herein include, but are not limited to, diethyl ether and tetrahydrofuran.

Examples of ketones that may be used in any of the methods described herein include, but are not limited to, acetone and 2-butanone.

Examples of esters that may be used in any of the methods described herein include, but are not limited to, methyl formate, methyl acetate, methyl propionate, ethylformate, ethyl acetate, ethyl propionate, ethyl butyrate, propyl acetate, propyl propanoate, isopropyl acetate, n-butyl acetate, sec-butyl acetate, and tert-butyl acetate.

Examples of hydrocarbons that may be used in any of the methods described herein include, but are not limited to, $C_5$-$C_2$ straight or branched-chain alkanes.

Examples of halogenated hydrocarbons that may be used in any of the methods described herein include, but are not limited to, chloroform, methylene chloride, carbon tetrachloride, and 1,2-dichloroethane.

Examples of aromatic hydrocarbons that may be used in any of the methods described herein include, but are not limited to, benzene, toluene, o-xylene, m-xylene, and p-xylene.

Interfacial Polymerization Process

Another embodiment of the present invention is a interfacial polymerization method for producing any of the microcapsules described herein.

In one embodiment, to encapsulate the lubricant additive (s), an aqueous suspension of emulsifier(s) was prepared. A lubricant additive or mixtures of lubricant additives and monomers of the polymer, a preformed polymer or monomer which may form a polymer in-situ, and, optionally, one or more organic solvent(s) was added to the aqueous suspension The solution was emulsified with stirring for 60 minutes at room temperature. The bath temperature was then raised to 40 to 80° over a period of 30 minutes and maintained at this temperature for a further 2-12 hours for the interfacial polymerization to form the microcapsules. The crosslinker(s) and initiator(s) were then added to initiate the polymerization. The reaction mass was then cooled and diluted with water. The microcapsules were isolated, washed with water, and dried. The microcapsules were produced having the core as a single additive or a mixture of two or more additives (polar and non-polar, polar and metal containing (metal coming from the additive such as the friction modifier), and/or non-polar and metal containing). The capsules surface was smooth and was formed with a size range of about 5 to 20 μm. The polymer shell thickness was 1±0.5 μm. The size of the microcapsules can be controlled by using ionic/non-ionic emulsifiers, and by changing the stirring speed (e.g., in a range of about 500 rpm to about 20,000 rpm), temperature (e.g., in a range of about 20° C. to about 100° C.), and concentration of the emulsifier (e.g., in a range of about 0.05 to about 2 wt. %).

The polymerization reactions are intrinsically exothermic, i.e., producing heat during the reactions and additional heat will raise the interfacial temperatures inside the water-oil interfacial layer. The interfacial layer thickness is controlled by many factors: emulsifiers used, reactor design, the presence of baffles, cooling mechanism, the power input from the agitation, the design and size of the propellers, etc. Conventional microencapsulation recipes simply state an agitation speed in terms of rpm, which does not define the processing conditions. Through judicious experimentation and capsule property monitoring, the present inventor has surprisingly developed microencapsulation processes that are able to produce consistent microcapsules defined by their properties as defined above.

Solvent Evaporation Process

Another embodiment of the present invention is a solvent evaporation method for producing any of the microcapsules described herein. This process is more economic and easier to scale up to produce large amount of the FM capsules. At the same time, the mechanical property of the microcapsules formed is in general about 20 to 40% weaker than the capsules produced by interfacial polymerization, due to the lack of cross-linking of the polymers formed. As discussed above, use of the microcapsules in automotive applications depends on the size of the engine, duty cycles, and design tolerance, or whether the engine is fortified by diamond-like coatings. It is envisioned that for some vehicles, the strength of the microcapsules should be tailored to various engines designs.

One embodiment of this invention is a method for preparing any of the microcapsules described herein by a solvent evaporation method In one embodiment, the solvent evaporation methods comprises the following steps:

i) The polymer used for the capsule shell material and the FM (or FMs or FM with several other additives) are dissolved in dichloromethane (DCM) or other organic solvents. An emulsifier is added, and the mixture is then emulsified in aqueous solution until uniform.

ii) The emulsion is then heated to evaporate the solvent forming the microcapsules.

Thus, in one embodiment, the present invention relates to a method for producing microcapsules, the method comprising:

i) dissolving (a) one or more friction modifiers, (b) one or more polymers (e.g., one or more polymers used to for the capsule shell), and (c) optionally one or more additional lubricant additives (e.g., antiwear additives, corrosion inhibitors, antioxidants and any combination thereof) in one or more solvent(s) (e.g., dichloromethane);

ii) adding one or more emulsifier(s);

iii) emulsifying the resulting mixture (e.g., by stirring);

iv) heating the product of step iii) to evaporate the one or more solvent(s) and form microcapsules.

The temperature and the stirring speed are controlled to evaporate the one or more solvent(s). Typical temperatures are in the range of about 50° C. to about 80° C. Typical stirring speeds are from about 500 rpm to about 800 rpm (to ensure smooth graduate solvent evaporation, depending which solvent or solvents to be evaporated). For example, for dichloromethane, a stirring speed of about 600 rpm is preferred.

In certain embodiments, the method further comprises v) filtering the dispersion;

vi) washing the dispersion; and vii) drying the microcapsules (e.g., at about 50° C. for about 12 hours).

In certain embodiments of any of the methods described herein, the ratio of core material (additives) to polymer (shell) is specified, in order to control the microcapsule shell wall thickness in the solvent evaporation method. It is desirable for a capsule to contain as much additives as possible while maintaining the shell wall thickness (strong capsules).

In certain embodiments, the ratio of core to shell (e.g., in the solvent evaporation process) ranges between about 3:1 to about 9:1. The preferred core to shell ratio for FMs or mixtures of additives is 4:1 or 3:1 or any ratio in between these ranges, depending on the specific FM molecular structures and molecular weight.

In certain embodiments, the evaporation temperature at a constant stirring rate can range from about 40° C. to about 80° C. (at high temperatures, nitrogen or argon atmosphere is required to prevent oxidation). The preferred temperatures in additive encapsulation are about 50° C. to about 60° C.

Encapsulation Efficiency and Additive Recovery Percent

In order to recover the additive from the microcapsules made from these two processes for formulation insertion as well as for quality control purposes, the microcapsules containing additives were broken using a variety of methods: shear, thermal, solvent extraction, and mechanical pressures to break open the capsules to allow recovery of the encapsulate. The use of high temperatures to release the encapsulated material has to be done under argon atmosphere to avoid oxidation. The lubricant additives were extracted in hexane and the polymer shell, being insoluble in hexane, was filtered. The hexane was evaporated, and the residue was weighed. Microcapsules prepared according to this invention have an encapsulation efficiency of about 50 to about 90%, with preferred recovery rates of about 70 to about 75% to balance shell thickness and additive content. Since the microcapsule is negatively charged at the surface, the interior of the capsule has to be positively charged and tend to attract the encapsulated additive or additives combination. Additive recovered from the capsules undergo performance tests compared with the virgin additive or additives.

Testing and Evaluation of the Microcapsules

Figure 17:
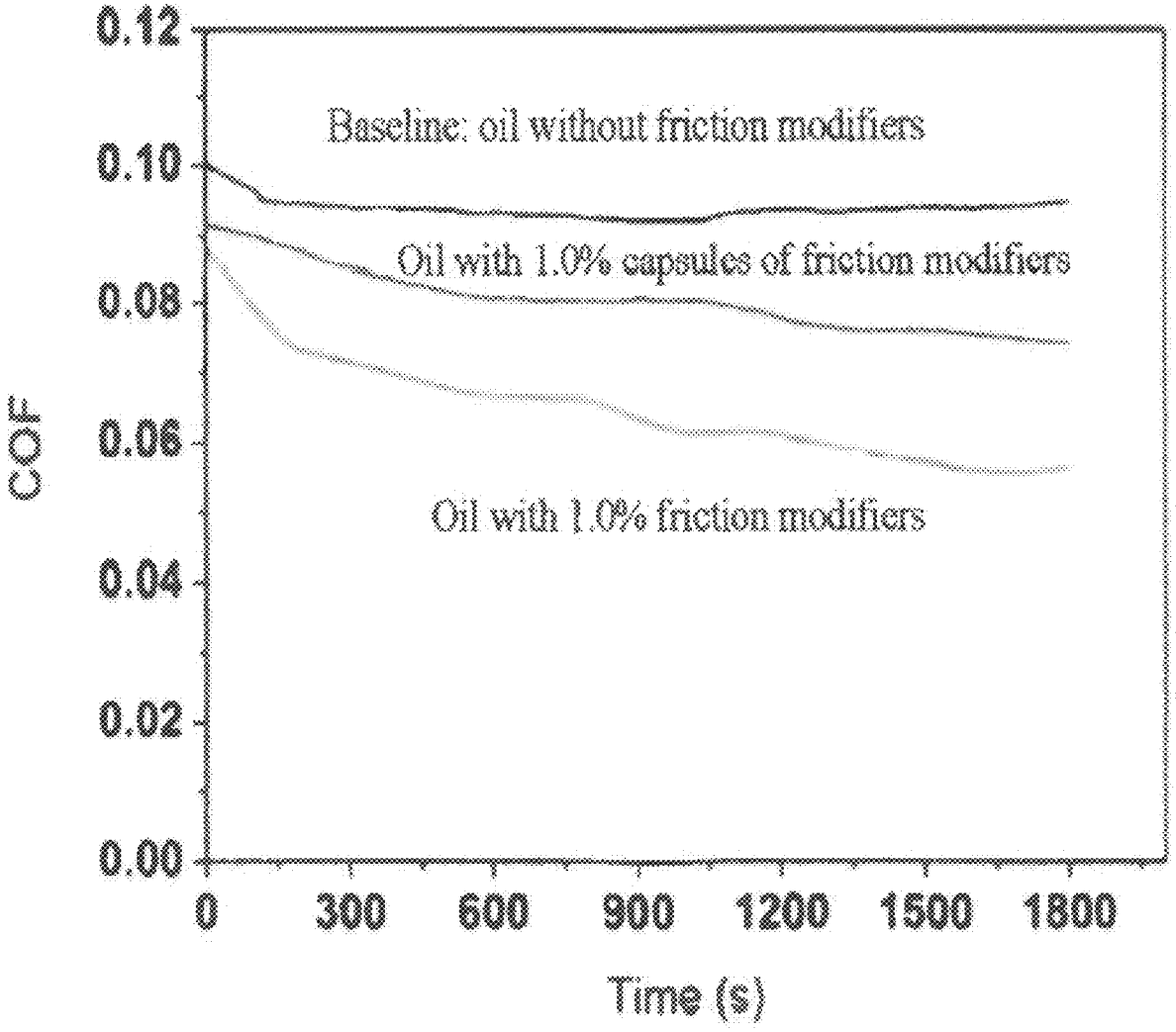
FIG. 17 shows the results of a friction test at 20 Kg, 3000 RPM for 30 minutes at room temperature for oil containing friction modifiers at 1.0% concentration.
Figure 18:
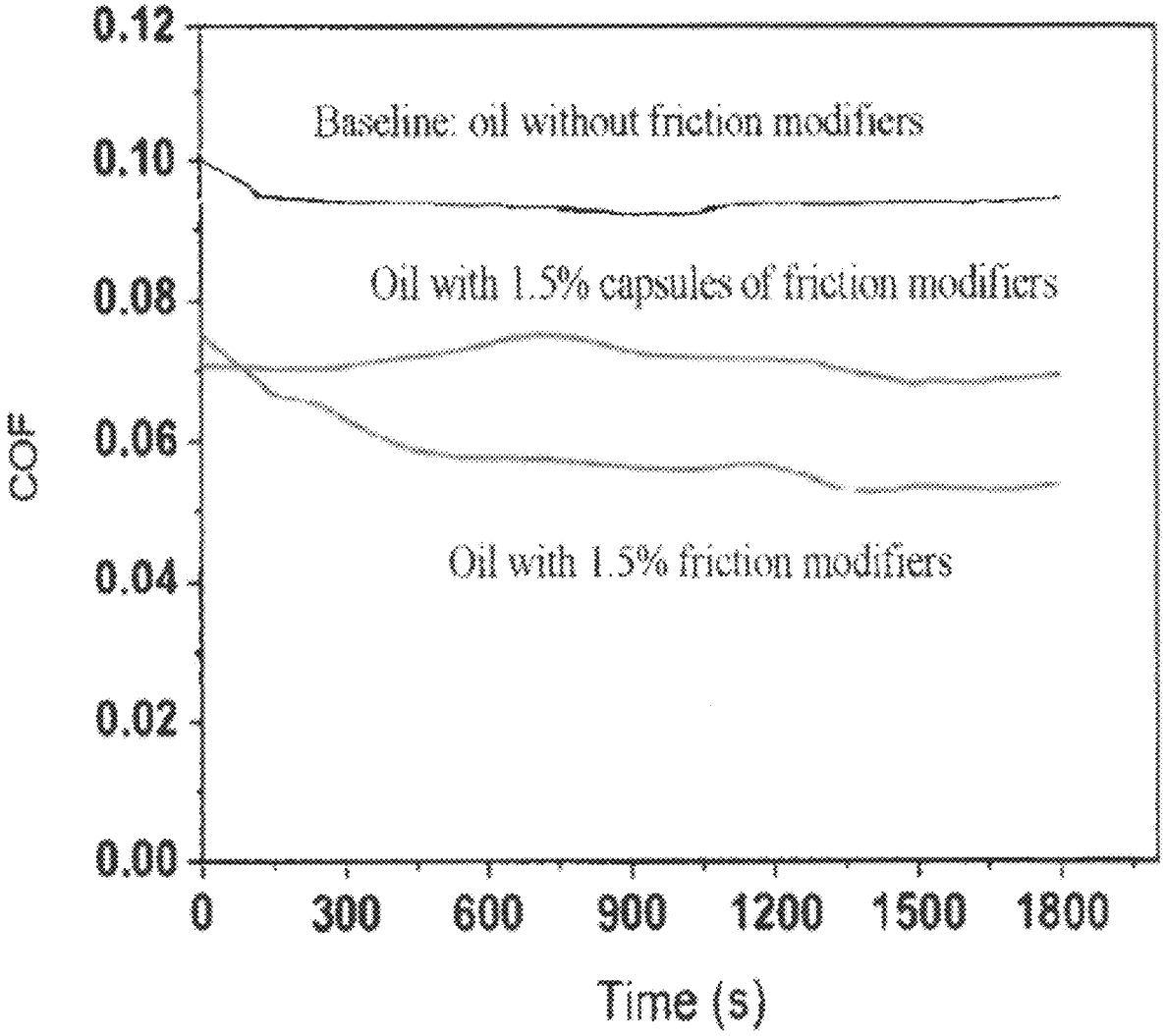
FIG. 18 shows the results of a friction test at 20 Kg, 3000 RPM for 30 minutes at room temperature for oil containing friction modifiers at 1.5% concentration.

To conduct the functionality test of the recovered additive from the microcapsules, fully formulated lubricating oil was used. The tests were conducted by two means: i) direct substation of the FM with microencapsulated FM at equal dosage level from the capsule recovery test results; and ii) adding to the formulated oil an additional microencapsulated FM or $FM^+$ antioxidant additive to test for prolonged FM performance. Oils with an encapsulated mixture of friction modifiers at 1.0% and 1.5% concentration were tested. The conditions for the friction test were set by carrying out ball-on-three-flats tests using a four-ball wear tester. The tests were conducted under 20 kg loads, 3000 rpm, room temperature for 30 minutes. The set of test conditions were chosen to give a coefficient of friction in the range from 0.09 to 0.1. The friction modifiers used were at an equivalent amount of microencapsulated friction modifiers and non-encapsulated friction modifiers. At a concentration of 1.0% (FIG. 17) and 1.5% (FIG. 18), the microencapsulated FM capsules showed friction decrease but higher than the uncapsulated FM at equal concentration.

Figure 19:
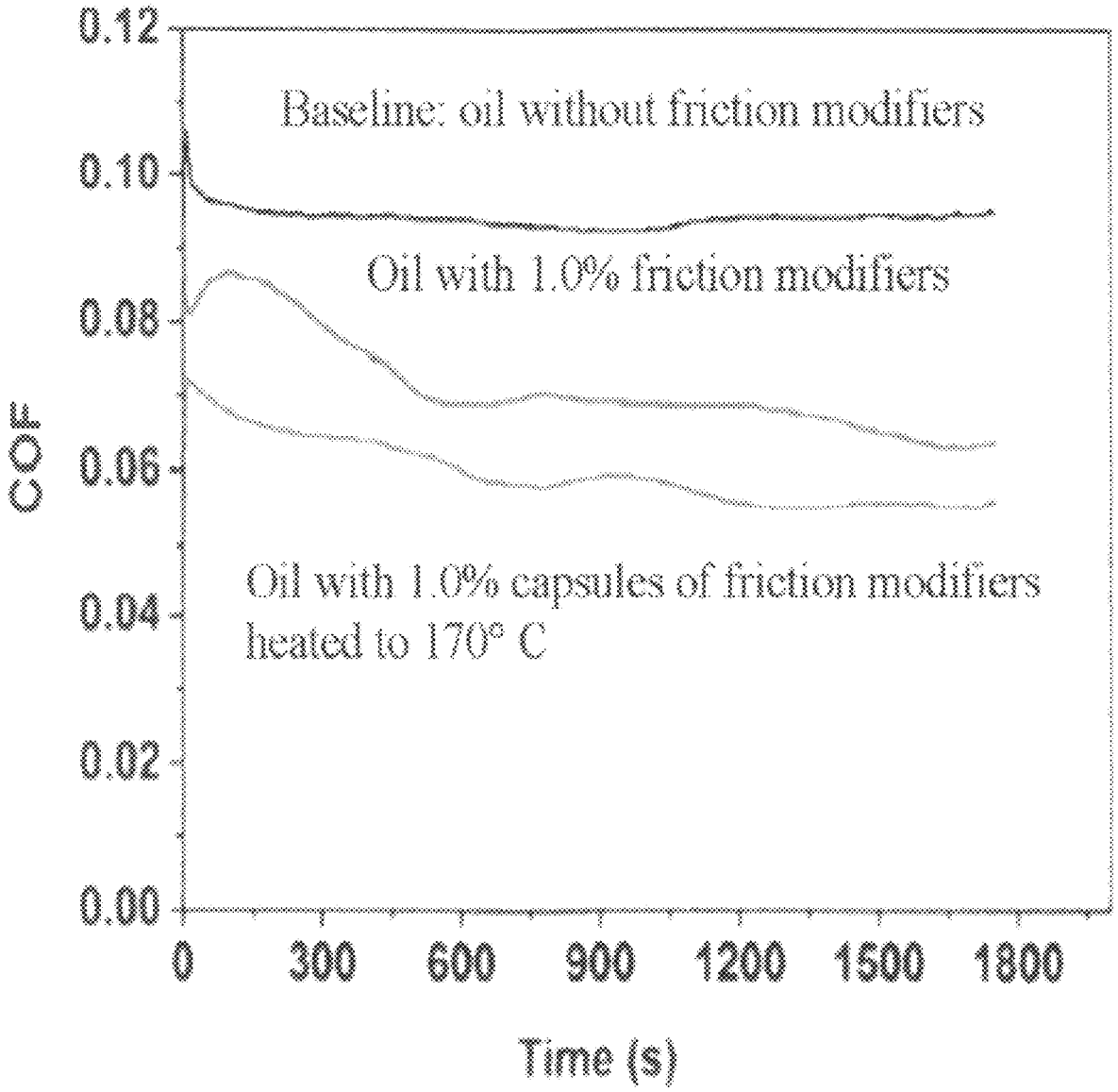
FIG. 19 shows the results of a friction test with oil containing capsules of friction modifiers and heated to 170° C. at 20 Kg, 3000 RPM for 30 minutes at room temperature at 1.0% concentration.
Figure 20:
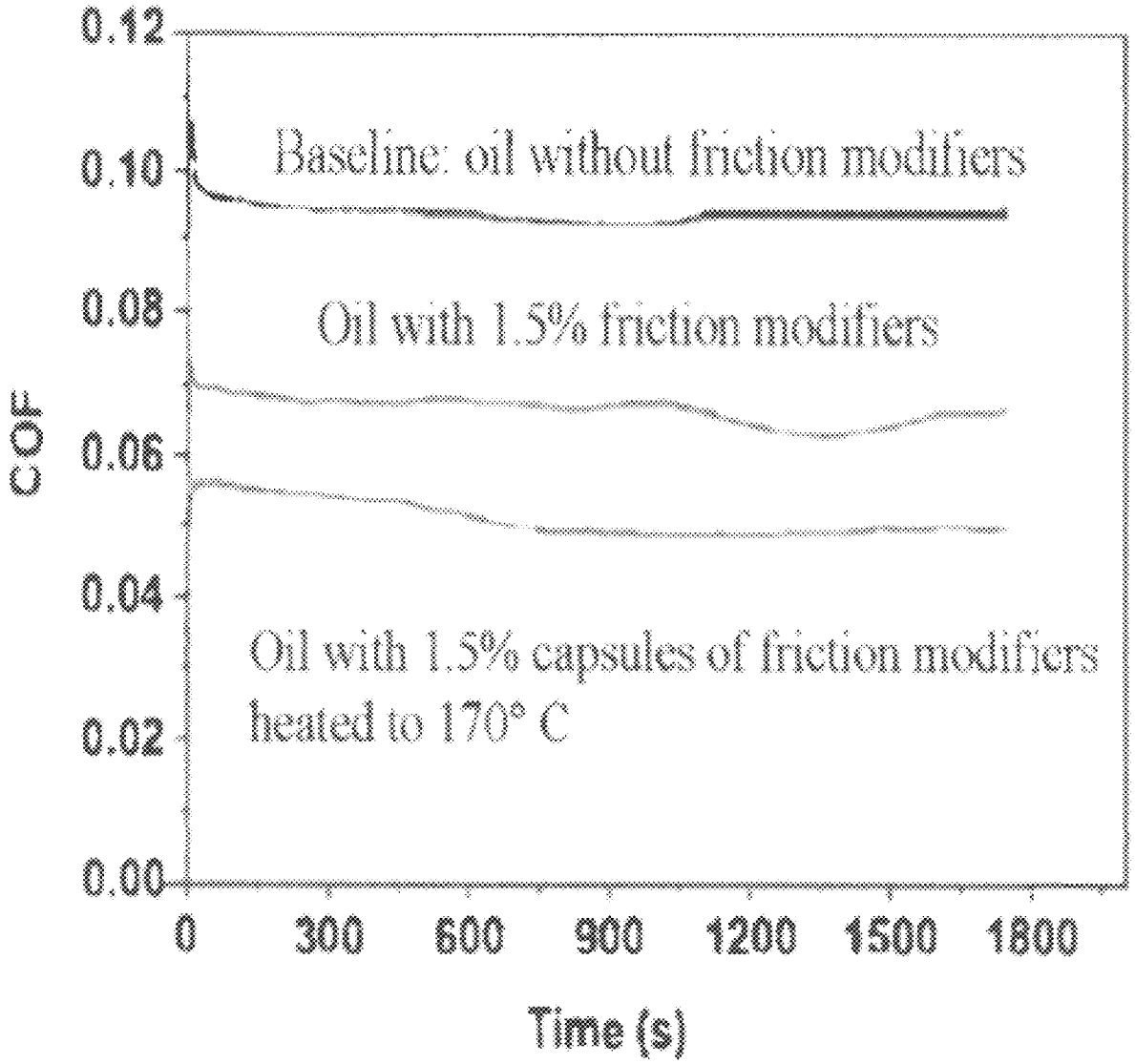
FIG. 20 shows the results of a friction test with oil containing capsules of friction modifiers and heated to 170° C. at 20 Kg, 3000 RPM for 30 minutes at room temperature at 1.5% concentration.

The test results suggested that the FM microcapsules release FM at a controlled rate under the test conditions. To test the friction level when all of the FM has been released, the oil containing the FM microcapsules was heated to 170° C. for 2 hours under a nitrogen atmosphere with agitation for the encapsulated friction modifiers to be released into the oil. The friction tests were then repeated with the same set of conditions (3000 rpm, 20 Kg, 30 minutes at room temperature). Two different concentrations (1.0% and 1.5%) were prepared and tested, as shown in FIGS. 19 and 20. At both the concentrations, 1.0% and 1.5%, the coefficient of friction is lower for the oil with microcapsules of friction modifiers as compared to the oil with the non-capsulated friction modifiers. The reason why capsulated FM outperforms the virgin FM is due to the fact that 100% of the virgin FM was subjected to degradation condition from the beginning during the wear tests, and the capsulated FM was protected from rapid degradation and therefore able to outperform the virgin FM.

Figure 21:
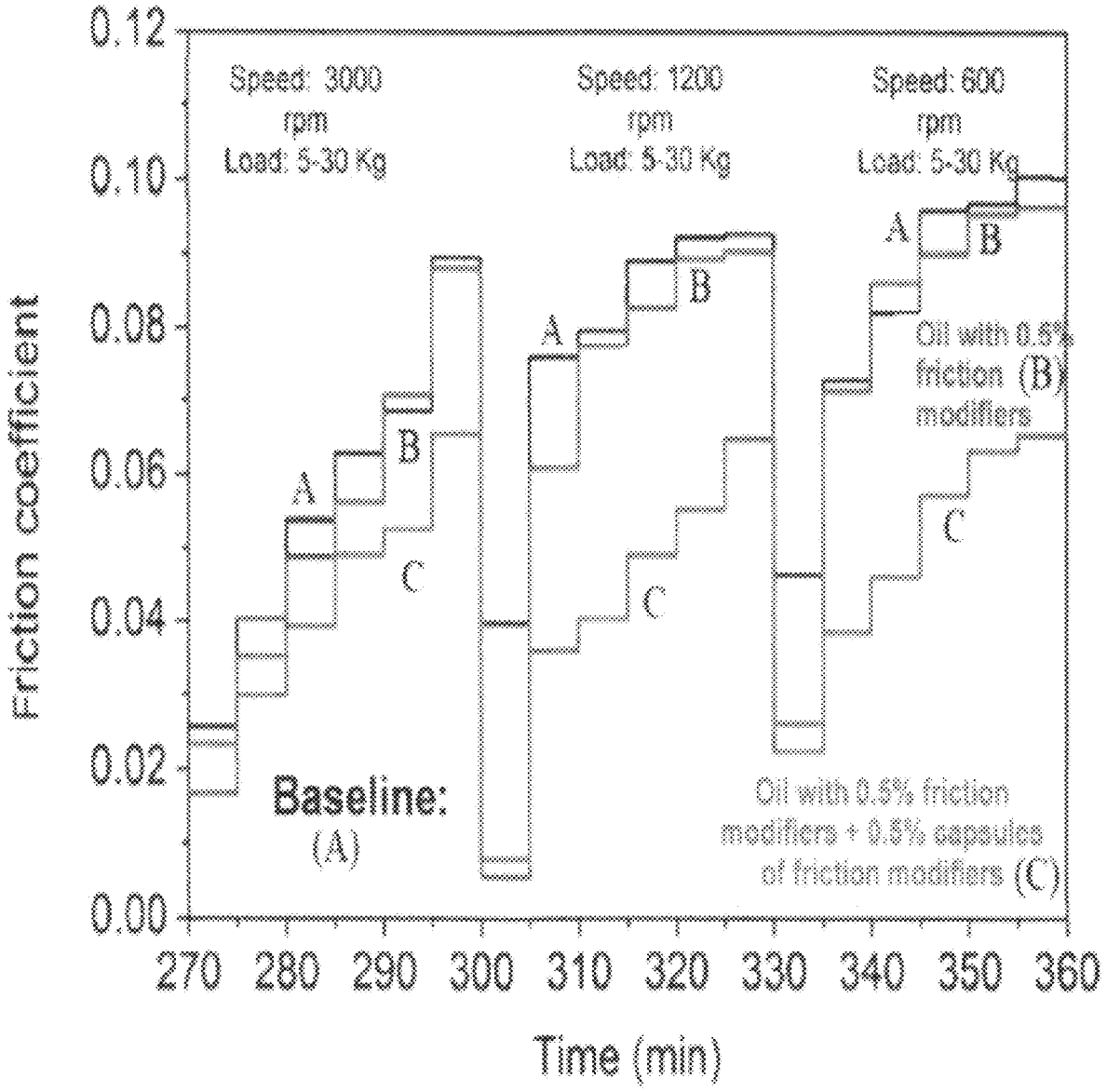
FIG. 21 shows the results of a friction test with oil containing capsules of friction modifiers at 5-30 Kg, 3000-600 RPM for 5 minutes at each load at 80° C. for oil containing friction modifiers at 0.5% concentration of friction modifier+0.5% concentration of capsules.

With the above set of data proving that the encapsulated FM being protected from rapid degradation yields better performance than the non-encapsulated FM, the static Ball-on-three-flats test was conducted to test the rapid transient conditions similar to the engine operational conditions. Rapidly changing speed and load sliding conditions are historically the severe condition for FM performance. The rapid transient friction test was conducted on a four-ball wear tester with a ball-on-three flats contact geometry. The test sequence was divided into a three speed sequence: 3000 rpm, 1200 rpm, and 600 rpm and within each speed, the load was cycling from 5 kg load to 30 kg every five minutes with a 5 kg step increase. The test took 360 minutes to complete. The baseline lubricant was fully formulated oil with the FM removed. The top line (trace A) line in FIG. 21. This was compared to the same lubricant with 0.5% virgin FM added (trace B). The third lubricant (trace C) has 0.5% virgin FM plus 0.5% capsulated FM added. The cycling test has three zones, the first zone has 3000 rpm, low load, typically in the hydrodynamic lubrication regime. The second zone has 1200 rpm, medium load, simulating the mixed lubrication regime. The third cycle has 600 rpm with the same loading cycle, simulating the boundary lubrication regime. It is in this regime, after the previous two cycles, the FM alone lost its effectiveness and the microcapsulated FM begin to release additional FM to maintain low friction. So, it simulates the condition that when the 0.5% virgin FM lost its effectiveness during the third cycle, the microcapsulated FM continued to provide low friction, as shown in FIG. 21.

There are large variety of engines and engine system configurations in the transportation industries and there are also a variety of oil injector pumps and oil filter systems used in various applications. For microencapsulated additives to function effectively, additional requirements for the microcapsules are needed. There are no microcapsules that will meet all the requirements posed by all engines and all systems with all duty cycles. The present invention aims to provide solutions to tailor-made microcapsules containing lubricant additives to function effectively in such defined applications.

Another aspect of this invention is to provide a solution to meet the requirement of releasing additives using controlled continuous additive release in a somewhat static environment by creating through-holes in the microcapsule shells. The release rate can be controlled by various sizes of the through-holes, shell thickness, lengths of the hole, and surface charges within the hole walls. The release rate can be controlled from diffusion to controlled leakage, depending on the temperature, size, or molecular weight of the encapsulate, and vibration frequency of the vehicle. Since the volume of the oil circulation from the oil sump to the hot zone of the engine is relatively small (also depends on the pump injection rate, which depends on the duty cycle and engine size). Conventional porous microcapsules tend to be spongy and weak which will not work in this application.

To create through holes in the microcapsule wall while maintaining the smooth relatively strong shell wall, has, to the best of the inventor's knowledge, not been done before. Current art teaches to use phase separation materials to create porous layers to release small molecules or gaseous encapsulates. But this causes the capsules to form very porous layers as the capsule wall and become very weak capsules. From the broader perspective, non-wetting agents with the polymethacrylate polymer but oleophilic or neutral material such as carbon nanotubes, or organic-inorganic molecules such as silanes would create through holes in the microcapsule shell wall. Silanes such as aminopropyltrimethoxysilane (APTMS), tetra-ethoxy orthosilicate (TEOS, trimethoxy octyl silane, etc. have been used to create holes capsule walls), high molecular weight alcohols such as oleyl-alcohol, can also be used. The creation of through holes, however, also depends on the concentration of the non-wetting agents used and also depends on the emulsifiers used in the process. An optimum combination of the non-wetting agents, the specific emulsifier used, and the processing conditions used.

Accordingly, in certain embodiments of any of the methods or microcapsules described herein, the microcapsule contains one or more through-holes.

The addition of non-wetting agents works for both the solvent evaporation and interfacial polymerization processes described herein with the addition of the agent at the proper concentration with corresponding emulsifiers used in each of the processes.

When adding non-wetting oleophilic materials to create holes in the microcapsule shell to facilitate controlled additive release, the emulsifiers used in the process are important. Non-polymeric emulsifiers such as sodium dodecylbenzene sulfonate are not suitable emulsifiers for this process. High molecular weight polymeric such as polyvinyl alcohol (MW 130.000 and up) are good emulsifiers for the non-wetting agents, which are typical small molecular weight and physically relatively small.

Suitable emulsifiers for this process are: polyvinyl alcohols with various molecular weights, sodium dodecyl-benzene, or other compatible emulsifiers, and any the emulsifiers listed in herein. For many of the emulsifiers, the ratio of emulsifier to non-wetting oleophilic materials is important in producing controlled clear-cut through-holes. In one embodiment, the amount of emulsifier(s) used is from about 0.1% to about 2% by weight, such as from about 0.25% to about 0.5% by weight, depending on the MW range of the emulsifier and the polymer used.

It has been suggested the use of specific chemicals that will cause overall phase separation creating highly porous polymeric shell. These phase separation agents created puffy, porous, loose shell wall, weakening the mechanical strength, which is not suitable for automotive engine applications. Non-wetting agents, on the other hand, are localized to form holes associated with specific material and the size of the holes and the number of holes can be controlled to some extent, with much less chemical change of the materials. So, non-wetting agents, such as single and multiwalled carbon nanotubes, some inorganic species, silanes, etc., can be used.

Another aspect of the present invention is an optimization process for fabricating various types of porous microcapsules by adjusting the amount of non-wetting agents, interfacial polymerization conditions, and the temperatures between the phases to form continuous phase polymeric shells with through holes in the porous microcapsule shell walls. The use of non-wetting agents or the small amount of phase separation agents described above applies to both interfacial polymerization microcapsule fabrication method and the solvent evaporation microcapsule fabrication method. These two basic fabrication techniques produce the basic microcapsules. Additional refinements (porosity, charge change, charge modification steps) techniques can be applied to the microcapsules equally.

According, in one embodiment, the present invention relates to a method of optimizing any of the methods for preparing microcapsules described herein (e.g., to form microcapsules with continuous phase polymeric shells with through holes in the porous microcapsule shell walls), comprising:

i) adjusting the amount of non-wetting agents, or ii) adjusting the interfacial polymerization conditions, or iii) adjusting the temperatures between the phases, or iv) any combination of i), ii) and/or iii)

to form continuous phase polymeric shells with through holes in the porous microcapsule shell walls.

They porous microcapsules have been tested in by using a liquid organic dye encapsulated by the two methods described previously and tested in oil solution at various temperatures from 25° C. to 80° C. and the rate of dye release was observed. Generally, the additive release rate increased with the rise of temperature, but depending on the formulations, the hole size, and total amount of holes on the capsules, the release rates can be controlled to allow slow release.

Another embodiment of the present invention is a method to fabricate microcapsules to pass through various filter media to stay in the lubricating oil. ASTM standard engine tests typically use a simple metal screen as the filter to facilitate the flow of the reaction products, increasing the severity of the tests. In vehicles, there are many types of filter media used but the materials used are primary cellulose (paper), blended with synthetic fibers such as glass fibers and polyester fibers. Resins are used to saturate the fibers to provide strength and stiffness. So, the filter primarily operates on depth filtration, even though they provide a nominal pore size diameter for the filter. There are also secondary filters which use magnetic medium, and all synthetic fibers with higher filtering efficiency. Taking into account of the pore size specification for most filters are 20 μm diameter to 40 μm diameter, but due to the depth filtration design, the microcapsule size should not exceed 10 μm to 12 μm in diameter.

Another aspect of the present invention is surface charge control. We tested the surface charge of the filtering media; they range from slightly positive charge to moderate positively charged. Since the microcapsules are negatively charged, the capsules will be filtered out regardless of the capsule diameter in relation to the nominal "filter pore size". To adjust the friction modifier laden microcapsules surface charge, the present inventor developed a technique to convert the PMMA microcapsules with a negatively charged surface to positively charged surface in order to pass through the filters commonly used in cars and trucks.

The present inventor is unaware of any prior process to convert a polymeric microcapsule containing friction modifiers from negatively charged microcapsule surface to a positively charged surface without interfering with the porous through holes that the invention described. The general principle is to adsorb controlled monolayer or ultra-thin positively charged nanoparticles at the exterior microcapsule shell wall without impeding the porous through holes built-into the microcapsule by the methods described herein, and at the same time, not too thick a layer to interfere with the designed functions of the microcapsules.

There are several techniques that are commonly used to deposit a monolayer silica nanoparticles on the capsule surface using a self-assembled monolayer (SAM) technique. The SAM monolayer technique is well-known, putting the microcapsules in a pure water bath in a clean room environment at very dilute solution of positively charged silicate nanoparticles for 12-24 hours. The nanoparticles will adsorb on the microcapsule surface about a monolayer deep. The SAM method was chosen for its ability to control the amount of the silicate particles on the capsule surface. The purpose of the controlled deposition of silicate nanoparticles is to control the surface charge to slightly positive but not strongly positive. Silicate nanoparticle at a monolayer strength will produce a slightly positive charge to pass through the filter media but not strongly enough to attract other additives in the oil, which are predominately negative surface charged.

Another aspect of this invention is a method to convert normally negatively charged silicate nanoparticles to positively charged particles. In one embodiments, the method comprises fictionalizing the negatively charged silicate nanoparticles with i) sodium bis-(2 ethylhexyl) sulfosuccinate (AOT) dispersant, and/or ii) a silane, such as, but not limited to, aminopropyl trimethoxysilane (APPTMS) or 3-aminopropyl trimethoxysilane (APTES). The choice is based on reactivity and charge intensity. To stabilize the attachment process, 0.5 ml of APTMS functionalized $SiO_2$ nanoparticles dispersion at a concentration of 0.02 g/ml was added to 50 ml of microcapsules dispersion concentration of 0.015 g/ml and stirred for 12 hours at room temperature. The ratio of the $SiO_2$ to microcapsules can be varied by using increasing amount of $SiO_2$ dispersion to increase the surface coverage of positively charged $SiO_2$, hence increase the positive charge intensity. The zeta potential of the AOT stabilization microcapsules is about −25 mV, when converted, the zeta potential became +24 mV. The positively charged capsules with capsule diameters between 8-10 μm diameters were fed through a commercial filter used in the engine chassis dynamometer test stand, and most of the capsules successfully passed through the filter.

Another aspect of the present invention is creating through-hole microcapsules not only to facilitate the steady diffusion controlled release of the additives inside the capsules, but also if some capsules got caught up on the filter medium (the filtration including depth filtration, as time went on, some capsules will get caught by the filter), the additives will continue to be released into the oil passing through the filter, thus achieving the timed-release intent and design.

One additional embodiment of the present invention is the extension of the previously discussed long polar molecule charge control and balance principles by pre-mixing several molecules to form a molecular cluster, the end combination of the molecular cluster will be either charge neutral, or slightly negative. All chemicals when in solution carry charges. When a long polar molecule is paired with rectangular (3D) molecule, the end result is much less polar. The case in point is the organic FM (long chain polar molecule) mixing with zinc dithiophosphate (rectangular neutral molecule) for example that have allowed us to encapsulate the organic FM. When investigated further, it was found possible to selectively pair some molecules first, then mix with other paired molecules, providing functionally synergistic functional enhancement and encapsulate the group. It has been demonstrated that up to 5 additive molecules can be combined together and encapsulate them into a single microcapsule.

In this embodiment, as an example, to encapsulate 3 antioxidants, one molybdenum-containing FM, one organic FM. When the microcapsules rupture, most of the original additives would have been degraded and rendered useless, so the lubricant would need a booster in antioxidation additives, and organic FM plus a moly-containing FM. For the antioxidants, an amine antioxidant, a phenolic antioxidant, and a high temperature phenol antioxidant are blended in ratios that would provide optimum synergistic performance. In this case, the amine and phenolic antioxidants will be paired first in a solution for 12 hours at 27° C. under an argon atmosphere, then add the high temperature phenolic antioxidant slowly with vigorous stirring for another 12 hours. The friction modifiers will then be blended in a ratio that will have synergism together at the same condition for 12 hours under an argon atmosphere. Then the two mixtures of the additives will be blended together at 27° C. overnight. The pre-pairing is important to make this method work. Then the final mixture will be microencapsulated according to normal microencapsulation procedures. Such combination of additive opens a new era of mini-packaging of inhibitors to be isolated from the overall formulation, when it is released, the effect on the lubricant is high impact.

Such mini-package also creates the concept of delivery of performance on demand, right to the location where it is needed because the additive release can be tailored to the specific location/conditions/environment at that location/condition.

The discovery of the concept of "charge neutralization" or charge optimization by mixing various molecules to create a stable aggregate cluster of several molecules that enable them to be encapsulated together is has, to the inventors best knowledge, never been carried out in microencapsulation of lubricant additives and applied to additive encapsulation. In this case, a "surrogate molecule" can be used to encapsulate a chemical that otherwise cannot be encapsulated due to interference with emulsion creation.

Another embodiment of this invention is the creation of an ultra-high performance package within a single capsule. For example, in applying friction modifiers to lubricants, molybdenum-containing FMs such as, but not limited to, molybdenum-dithiocarbamate (MoDTC) can form $MoS_2$ in situ. Depending on the structures, the initiation of decomposition and availability of sulfur atoms in the immediate vicinity often require high temperatures to get the reaction to proceed to form $MoS_2$. Once the $MoS_2$ is formed, under boundary lubrication conditions, the $MoS_2$ film often oxidizes, forming moly-trioxide on the surface of the film, losing the friction reduction properties. To make this additive overcome the initiation barrier, the MoDTC may be paired with sulfurized olefins, another friction modifier, making sulfur readily available. To prolong the useful life of the $MoS_2$ film, surface oxidation inhibitors may also be added. Finally, the organic friction modifier is added into the mix to produce a microcapsule containing the four chemicals (FM, sulfurized olefin, surface oxidation inhibitor and organic friction inhibitor) with an optimized ratio of the four components. The resulting friction reduction properties are significantly enhanced, the initiation temperature is much lower, and the low friction duration is substantially prolonged.

The porous microcapsules containing friction modifiers without surface charge modification were blended in an experimental OW-16 lubricant (George Washington University), which lubricant has gone through extensive fuel economy tests in the same series. The engine tests were conducted on a Chassis engine dynamometer on a 5.3 L 350 hp modern engine equipped with up-to-date fuel-efficient technologies such as direct injection, active fuel management and variable valve timing with an advanced combustion system. To improve the test precision, a baseline oil was tested before and after the candidate oil. The fuel economy was determined by fuel metering, and tailpipe carbon analysis. The test procedure lasted for 5 days. For each oil, the engine test started by flushing the engine with the test oil. A daily test using cold start FTP (EPA city driving cycle) followed by a double FFE (EPA highway test cycle) for the day. The test cycles were the same test protocol used in the EPA CAFE tests.

Since one of the primary purposes is to use the microcapsulated additives to prolong the effective of friction modifiers, the test protocol was designed similarly. The initial phase is the fuel economy daily tests with a cold start, followed with an FTP (EPA city driving cycle), FFE (EPA highway driving cycle) and the combined driving cycle. Then the engine was shut down and restarted next day for five consecutive days. Since microencapsulated friction modifiers should prolong the low friction performance period, the test procedure would need to be modified to test the extended time period to observe the prolonged fuel economy benefits. The test was stopped, and vehicle was put on mileage accumulator for one week repeating the test cycles for 500 miles. Then the fuel economy testing would start again to see whether the fuel economy results changed over time. A total of three engine tests were conducted. The table in FIG. 22 shows the test results. The data represent the average of the 5 day test results and compared with the baseline data before and after the 5 day testing. The initial test showed that the microcapsules improved the city driving cycle in this engine by 1.2% but lost 0.8% in the highway cycles. After 500 miles in the test engine, the oil was tested again. In this case, both the city and highway cycles showed an improvement of 0.7% improvement in fuel economy.

Subsequent analysis showed the engine parts are clean without varnish or sludge or additional deposits. The microcapsules were collected by the filter media. There were no microcapsules in the oil, but the fuel economy improvement was noted.

Modified FM capsules have been developed with positive surface charge and it has been demonstrated that the improved microencapsulated FMs described herein will pass through the filter and function normally, leading to better fuel economy improvement.

The description of the present embodiments of the invention has been presented for purposes of illustration but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention. Patents and publications cited herein are incorporated by reference in their entirety.

What is claimed is:

1. A method for microencapsulating an organic friction modifier, the method comprising:

(a) coupling the organic friction modifier in solution with a neutral surrogate molecule or a surrogate molecule having a surface charge opposite to that of the organic friction modifier, to form an organic friction molecule having reduced polarity or a lower surface charge density; and (b) encapsulating the organic friction modifier having reduced surface charge by either a solvent evaporation process, an interfacial polymerization process, or a layer-by-layer deposition process.

2. The method of claim 1, wherein the organic friction modifier is selected from the group consisting of a long chain fatty acid, a long chain fatty alcohol, a long chain fatty ester, a long chain fatty amine, a long chain fatty amide, a long chain fatty glyceride, and any combination of any of the foregoing.

3. A method of producing one or more through-holes in a capsule shell of a capsule comprising one or more oil additives formed during an encapsulation process, the method comprising:

coupling one or more oil additives with a surrogate molecule to form an oil additive having a negatively charged surface;

encapsulating the oil additive having the negatively charged surface in a capsule shell; and adding one or more non-wetting agents during encapsulation process to form one or more though-holes in the capsule shell, wherein the one or more through holes allow for continuous release of the oil additive from the capsule in a working automotive engine.

4. The method of claim 3, wherein the one or more non-wetting agents are selected from the group consisting of a silane, an alcohol, a carbon nanotube, and any combination of any of the foregoing.

5. The method of claim 4, wherein the one or more non-wetting agents are selected from the group consisting of aminopropyl trimethoxysilane (APTMS), tetraethoxy orthosilicate (TEOS), trimethoxy ortho silane (TMOS), oleyl alcohol (OA), and any combination of any of the foregoing.

6. The method of claim 3, wherein the one or more through holes allow for continuous release of the oil additive from the capsule when the capsule is captured by a filter and/or remains in an oil pan in a working automotive engine.

7. A method of allowing an encapsulated oil additive to pass through a filter in a working automotive engine, the method comprising converting an encapsulated oil additive with a negatively charged surface to an encapsulated oil additive with a positively charged surface, thereby allowing the encapsulated oil additive to pass through a filter in the working automotive engine, wherein the encapsulated oil additive is prepared by a method comprising:

(a) coupling an oil additive with a surrogate molecule to form an oil additive having a negatively charged surface; and (b) encapsulating the oil additive having the negatively charged surface.

8. The method of claim 7, wherein the converting step comprises depositing a monolayer of silica nanoparticles on a surface of a capsule containing the encapsulated oil additive.

9. The method of claim 8, further comprising functionalizing the encapsulated oil additive having a monolayer of silica nanoparticles on the surface with sodium bis-(2-ethylhexyl) sulfosuccinate, a silane, or any combination of any of the foregoing.

10. A method of encapsulating two or more oil additives in a single capsule, the method comprising:

(a) encapsulating a first mixture of pre-paired oil additives to form a first encapsulated oil additive package, wherein encapsulating comprises:

coupling the pre-paired oil additives with a surrogate molecule to form pre-paired oil additives having reduced polarity or a lower surface charge density; and encapsulating the pre-paired oil additives having reduced surface charge;

(b) repeating step (a) one or more times to form one or more additional encapsulated oil additive package(s);

(c) encapsulating the product of step (a) and the product of step (b) into a single capsule in the presence of an additive that allows a surface charge of the product of step (a) and/or the product of step (b) to be reduced.

11. The method of claim 10, wherein the additive that allows a surface charge of the product of step (a) and/or the product of step (b) to be reduced is a zinc dialkyl dithio phosphate.

12. The method of claim 10, wherein the two or more oil additives are selected from the group consisting of organic friction modifiers, molybdenum based friction modifiers, antioxidants, detergents, dispersants, antiwear additives, surface deactivators, acid neutralizing agents, lubricant film enhancers, smart viscosity modifiers, corrosion inhibitors, rust inhibitors, high base materials, reparative agents, power point depressants, seal compatibility agents, antifoam agents, viscosity index improvers, heat transfer agents, surface reactivity control agents, and any combination of any of the foregoing.

* * * * *